US009027921B2

(12) United States Patent
Matsuno

(10) Patent No.: US 9,027,921 B2
(45) Date of Patent: May 12, 2015

(54) SHEET SIZE SETTING DEVICE, AND SHEET FEEDING APPARATUS AND IMAGE FORMING APPARATUS INCLUDING THE SAME

(71) Applicant: KYOCERA Document Solutions Inc., Osaka-shi, Osaka (JP)

(72) Inventor: Akinori Matsuno, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/496,307

(22) Filed: Sep. 25, 2014

(65) Prior Publication Data

US 2015/0084276 A1 Mar. 26, 2015

(30) Foreign Application Priority Data

Sep. 26, 2013 (JP) ..... 2013-200026

(51) Int. Cl.

| | |
|---|---|
| ***B65H 1/04*** | (2006.01) |
| ***G03G 15/00*** | (2006.01) |
| ***B65H 7/02*** | (2006.01) |
| ***B65H 5/06*** | (2006.01) |
| ***B65H 3/06*** | (2006.01) |

(52) U.S. Cl.

CPC ..... *G03G 15/5029* (2013.01); *B65H 1/04* (2013.01); *B65H 7/02* (2013.01); *B65H 5/06* (2013.01); *B65H 3/0669* (2013.01); *B65H 2511/10* (2013.01)

(58) Field of Classification Search

CPC .. B65H 1/04; B65H 2403/45; B65H 2511/10; B65H 2511/11; B65H 2511/12

USPC ..... 271/145, 171

See application file for complete search history.

(56) References Cited

U.S. PATENT DOCUMENTS

| | | | | |
|---|---|---|---|---|
| 5,572,310 | A * | 11/1996 | Hoberock et al. | 399/370 |
| 5,839,047 | A * | 11/1998 | Hirabayashi et al. | 399/389 |
| 8,444,140 | B2 * | 5/2013 | Mizuguchi et al. | 271/171 |
| 2013/0134658 | A1 * | 5/2013 | Nagai | 271/171 |

FOREIGN PATENT DOCUMENTS

| | | |
|---|---|---|
| JP | 2009-073664 | 4/2009 |

* cited by examiner

*Primary Examiner* — Michael McCullough

(74) *Attorney, Agent, or Firm* — Gerald E. Hespos; Michael J. Porco; Matthew T. Hespos

(57) ABSTRACT

A sheet size setting device gives information for identifying a sheet size. The sheet size setting device includes a first rotary member, an engaging portion, a biasing member, a second rotary member, and an assisting mechanism. The first rotary member has a cylindrical shape, and is rotatable around and slidably movable along a first axis. The second rotary member is supported rotatably around a second axis parallel to the first axis. The first rotary member includes a plurality of detected portions, a plurality of engaged portions, and a first gear portion. The engaging portion is operable to engage with one of the plurality of engaged portions to thereby restrict the rotation of the first rotary member. The assisting mechanism applies a moving force to the first rotary member in the axial direction with the rotation of the second rotary member so that the engaged portion disengages from the engaging portion.

10 Claims, 21 Drawing Sheets

SHEET SIZE SETTING DEVICE, AND SHEET FEEDING APPARATUS AND IMAGE FORMING APPARATUS INCLUDING THE SAME

This application is based on Japanese Patent Application No. 2013-200026 filed with the Japan Patent Office on Sep. 26, 2013, the contents of which are hereby incorporated by reference.

BACKGROUND

The present disclosure relates to a sheet size setting device for setting a size of sheets stored in a sheet feeding cassette or the like, and a sheet feeding apparatus and an image forming apparatus including the same.

Image forming apparatuses such as a printer, a copier, a facsimile apparatus and a composite machine equipped with all of these functions include a sheet feeding cassette for storing a plurality of sheets that are to be subjected to image formation. Generally, a sheet feeding cassette capable of storing sheets of various sizes is detachably mounted to a main body of an image forming apparatus. Conventionally, there has been known a sheet size setting device for notifying an image forming apparatus of a size of sheets stored in a sheet feeding cassette.

The sheet size setting device is of a dial type and includes an indicator of a sheet size, and detection pattern portions each corresponding to a different size to be indicated on the indicator and capable of being identified by a specific detection sensor. A user rotates the sheet size setting device to an appropriate position according to a size of sheets stored in the sheet feeding cassette, to thereby allow the indicator to indicate the sheet size and the detection sensor to identify the sheet size.

In the above technique, the sheet size setting device is formed with a plurality of concave portions disposed in a circumferential direction, the concave portions corresponding to the different sheet sizes. One of the concave portions is brought into engagement with a protrusion disposed on the sheet feeding cassette to thereby set a position of the sheet size setting device. Further, there is a spring disposed in a compressed manner between the sheet feeding cassette and the sheet size setting device to bias the concave portion toward the protrusion. In order to change a set sheet size, a user needs to rotate the sheet size setting device against the biasing force.

SUMMARY

A sheet size setting device according to an aspect of the present disclosure gives information for identifying a sheet size to a sheet size detector. The sheet size setting device includes a housing, a first rotary member, an engaging portion, a biasing member, a second rotary member, and an assisting section. The housing includes a first mounting section having a first space, and a second mounting section adjacent to the first mounting section and having a second space. The first rotary member has a cylindrical shape, and is supported on the first mounting section, and rotatable around and slidably movable along a first axis extending to the second space in the first space. The engaging portion is provided in the housing. The second rotary member is supported on the second mounting section rotatably around a second axis parallel to the first axis. The first rotary member includes a first region, a second region, and a third region along the first axis. The first rotary member includes a plurality of detected portions, a plurality of engaged portions, and a first gear portion. The plurality of detected portions are disposed in the first region and in a circumferential direction of the first rotary member to be detected by the sheet size detector. The plurality of engaged portions are disposed in the second region, and correspond to the plurality of detected portions in the circumferential direction of the first rotary member. The plurality of engaged portions can be selectively engaged with the engaging portion. The first gear portion is disposed in the third region for receiving a driving force for rotation around the first axis. The housing includes a first supporting plate and a second supporting plate. The first supporting plate defines one end of the first space in an axial direction of the first rotary member. The second supporting plate is disposed oppositely to the first supporting plate to define the other end of the first space in the axial direction, and divides the first space from the second space. The second supporting plate has a bearing opening for allowing the first gear portion of the first rotary member to pass therethrough. The engaging portion is disposed on the second supporting plate in such a way as to face the engaged portion, and is operable to engage with one of the plurality of engaged portions in the rotation of the first rotary member around the first axis to thereby restrict the rotation of the first rotary member. The biasing member is disposed between the first supporting plate and the first rotary member for biasing the first rotary member in a direction of permitting the engaged portion to engage with the engaging portion. The second rotary member includes a second gear portion and a disk portion. The second gear portion is disposed on the second axis and engaged with the first gear portion. The disk portion is operable to rotate the second gear portion. The second rotary member is rotated in a specific direction around the second axis to rotate the first rotary member to set a sheet size. The assisting mechanism applies a moving force to the first rotary member in the axial direction with the rotation of the second rotary member around the second axis so that the engaged portion disengages from the engaging portion against the biasing force of the biasing member.

A sheet feeding apparatus according to another aspect of the present disclosure includes the above-described sheet size setting device, a sheet feeding cassette, a sheet size detector, and a sheet feeder. The sheet feeding cassette stores sheets, and a part of the sheet feeding cassette constitutes the housing. The sheet size detector detects a size of a sheet stored in the sheet feeding cassette by detecting the detected portion. The sheet feeder feeds the sheet from the sheet feeding cassette.

An image forming apparatus according to another aspect of the present disclosure includes the above sheet feeding apparatus and an image former. The image former forms an image on a sheet supplied from the sheet feeding cassette.

These and other objects, features and advantages of the present disclosure will become more apparent upon reading the following detailed description along with the accompanying drawings.

DETAILED DESCRIPTION

Figure 1:
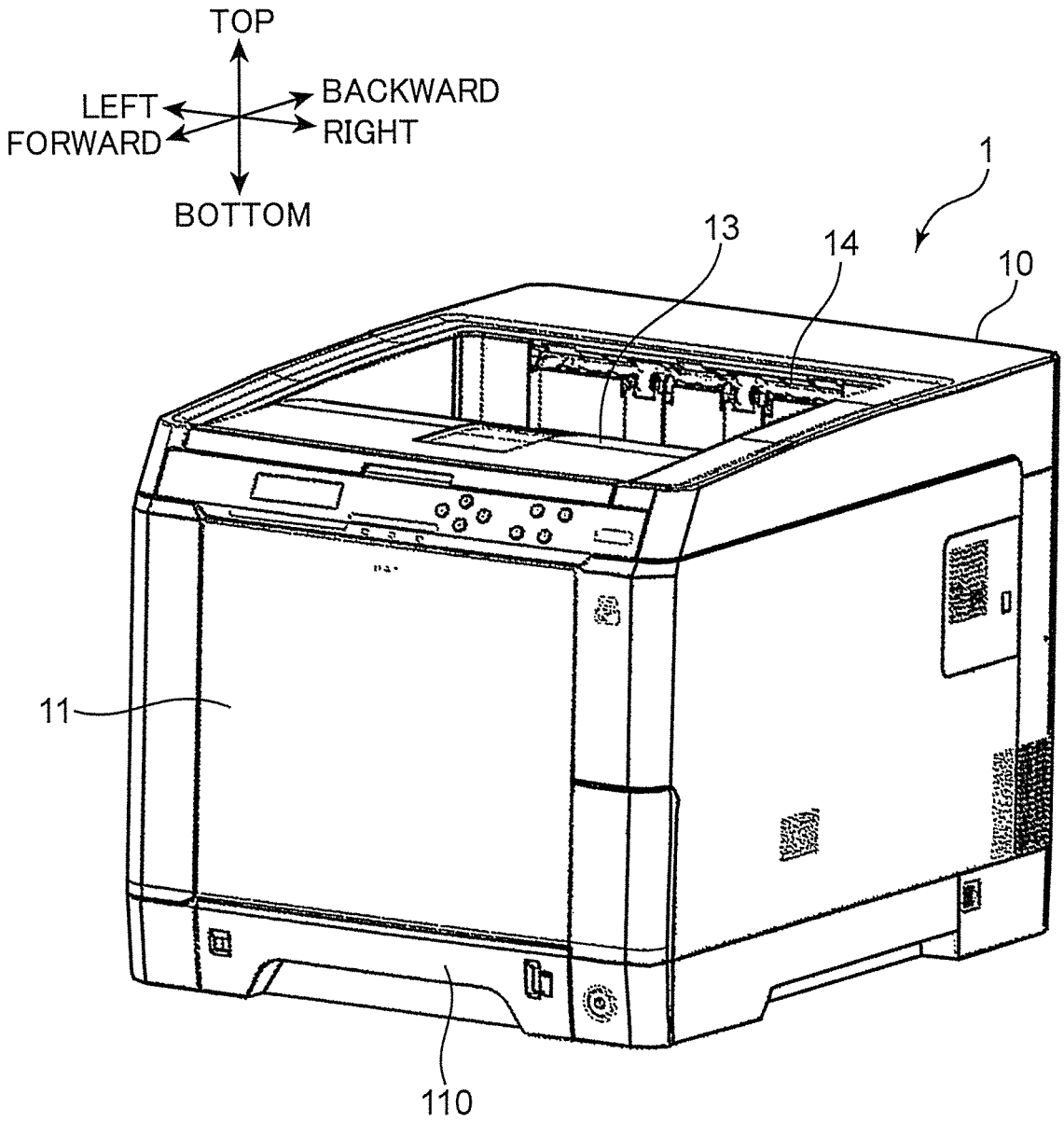
FIG. 1 is an external perspective view of an image forming apparatus according to a first embodiment of the present disclosure.
Figure 2:
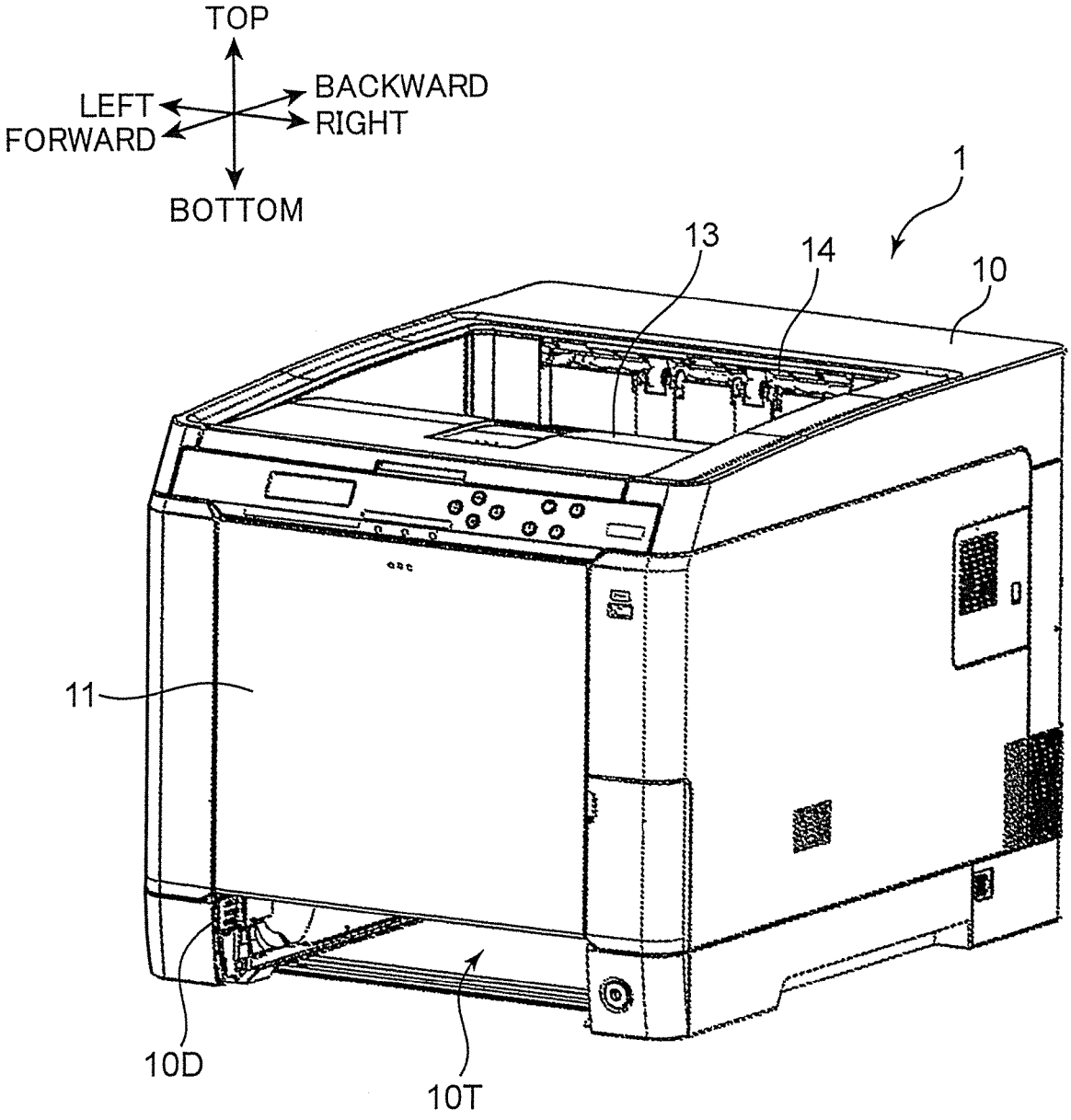
FIG. 2 is a perspective view of the image forming apparatus according to the first embodiment of the present disclosure with a sheet feeding cassette detached.
Figure 3:
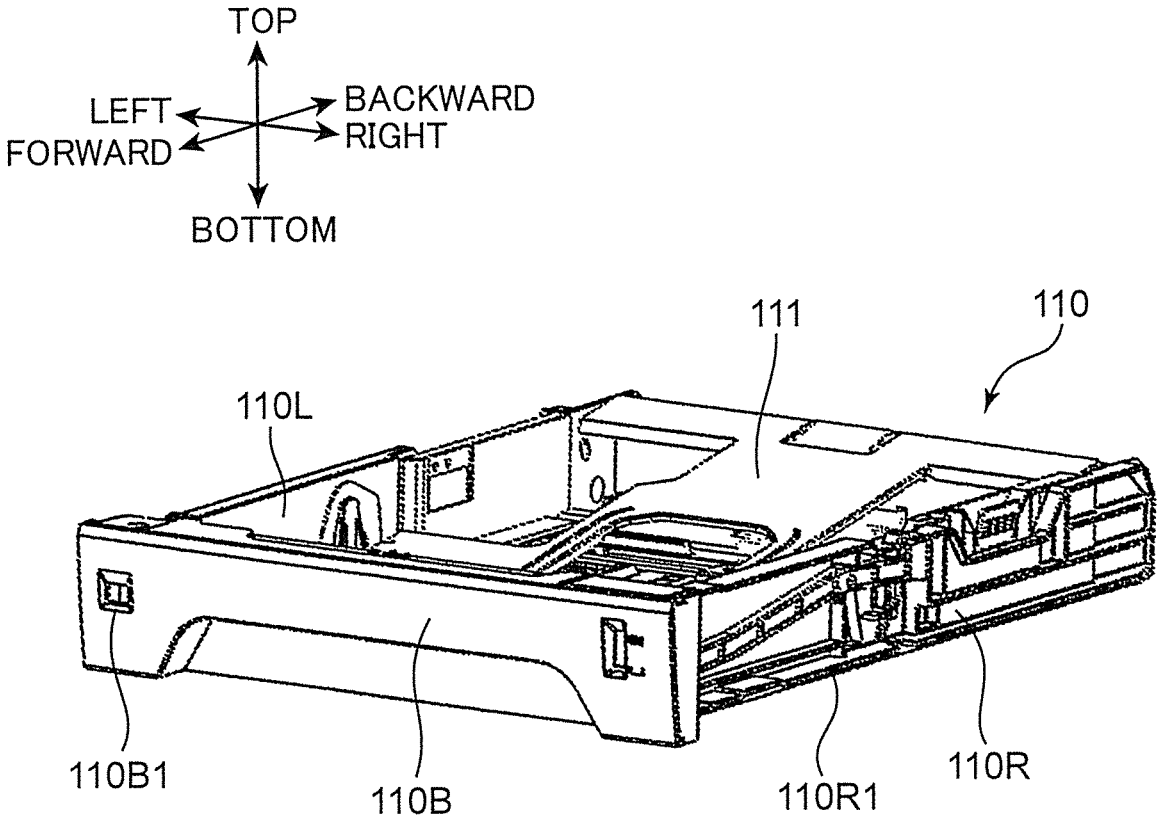
FIG. 3 is a perspective view of the sheet feeding cassette according to the first embodiment of the present disclosure.
Figure 4:
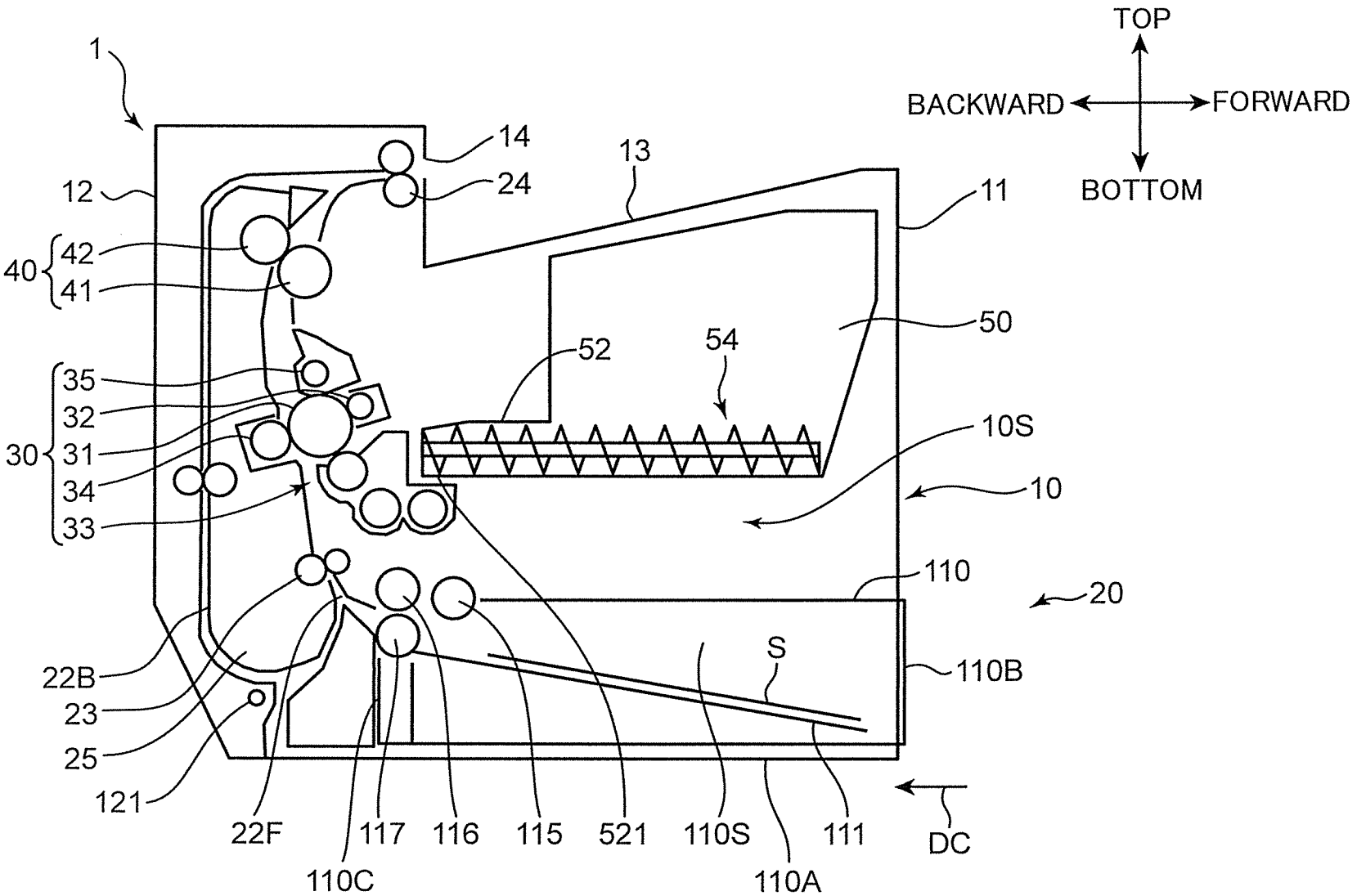
FIG. 4 is a schematic sectional view showing an internal structure of the image forming apparatus according to the first embodiment of the present disclosure.

Hereinafter, embodiments of the present disclosure will be described in detail with reference to the accompanying drawings. FIG. 1 is an external perspective view of an image forming apparatus 1 according to a first embodiment of the present disclosure. FIG. 2 is a perspective view of the image forming apparatus 1 shown in FIG. 1 with a cassette 110 detached. FIG. 3 is a perspective view of the cassette 110 according to the first embodiment of the present disclosure. FIG. 4 is a schematic sectional view showing an internal structure of the image forming apparatus 1. Here, the image forming apparatus 1 will be illustrated as a monochrome printer, but it may alternatively be provided as a copier, a facsimile apparatus or a composite machine equipped with all of these functions, or an image forming apparatus for forming a color image.

The image forming apparatus 1 includes a main body housing 10 (casing) having a substantially rectangular parallelepiped casing structure, and an image forming section 30, a fixing section 40, a toner container 50, and a sheet feeding section 20 (sheet feeding device) housed in the main body housing 10.

The main body housing 10 has a front cover 11 and a rear cover 12. The front cover 11, the rear cover 12, and a sheet discharge section 13 define an internal space 10S in which various components for image formation are disposed.

The image forming section 30 forms a toner image on a sheet that is fed from the sheet feeding section 20. The image forming section 30 includes a photoreceptor drum 31, a charging device 32 disposed around the photoreceptor drum 31, an exposure device (not shown in FIG. 2), a developing device 33, a transfer roller 34, and a cleaning device 35.

The photoreceptor drum 31 having a rotary axis and a cylindrical surface rotates around the rotary axis. The cylindrical surface is formed with an electrostatic latent image, and carries a toner image corresponding to the electrostatic latent image.

The charging device 32 charges the surface of the photoreceptor drum 31 substantially uniformly.

The cleaning device 35 includes an unillustrated cleaning blade to clean toner adhered to the circumferential surface of the photoreceptor drum 31 after a toner image is transferred therefrom, and conveys the toner to an unillustrated recovering device.

The exposure device includes a laser light source and an optical device such as mirror and lens to irradiate the circumferential surface of the photoreceptor drum 31 with light to form an electrostatic latent image, the light having been modulated in accordance with image data received from an external device such as personal computer. The developing device 33 supplies toner to the circumferential surface of the photoreceptor drum 31 to develop the electrostatic latent image formed on the photoreceptor drum 31 into a toner image.

The transfer roller 34 transfers a toner image formed on the circumferential surface of the photoreceptor drum 31 onto a sheet.

The fixing section 40 fixes a transferred toner image onto a sheet. The fixing section 40 includes a fixing roller 41 having a built-in heating source, and a pressing roller 42 to be brought into pressure contact with the fixing roller 41 to define a fixing nip between the pressing roller 42 and the fixing roller 41.

The toner container 50 stores replenishment toner to be supplied to the developing device 33. The toner container 50 includes a rotating member 54, and a cylindrical part 52 having a tip bottom surface formed with a toner discharge port 521. The rotating member is rotationally driven to supply the replenishment toner stored in the toner container 50 from the toner discharge port 521.

The sheet feeding section 20 includes the cassette 110 (sheet feeding cassette) for storing sheets S that are to be subjected to image formation. The cassette 110 includes a sheet storage 110S for storing the stack of sheets, a lift plate 111 for lifting the stack of sheets for feeding a sheet, and the like. The sheet feeding section 20 further includes a pickup roller 115 (sheet feeder), a sheet feeding roller 116, and a counter roller 117. The pickup roller 115 feeds a sheet S from the cassette 110. The sheet feeding roller 116 conveys the sheet fed out by the pickup roller 115 further downstream in a conveyance direction. The counter roller 117 functions to separate the sheet S fed out by the pickup roller 115 from another sheet. The sheet S is conveyed into a main conveyance passage 22F to be described later, the main conveyance passage extending from the cassette 110 in the main body housing 10.

The main body housing 10 includes therein the main conveyance passage 22F and a reverse conveyance passage 22B for conveying a sheet. The main conveyance passage 22F extends from the sheet storage 110S of the sheet feeding section 20 to a sheet discharge port 14 through the image forming section 30 and the fixing section 40, the sheet discharge port 14 being provided in such a way as to face the sheet discharge section 13. The reverse conveyance passage 22B is provided for returning a sheet having one side printed to an upstream side of the main conveyance passage 22F from the image forming section 30, in a case where it is necessary to have the other side of the sheet printed.

The main conveyance passage 22F extends upward from below so as to pass a transfer nip defined by the photoreceptor drum 31 and the transfer roller 34. On the upstream side of the main conveyance passage 22F from the transfer nip, there is provided a pair of registration rollers 23. A sheet is temporally stopped by the pair of registration rollers 23 to be subjected to skew correction, and then fed into the transfer nip at a predetermined timing for image transfer. A plurality of conveyance rollers for conveying a sheet is disposed at proper positions in the main conveyance passage 22F and the reverse conveyance passage 22B. For example, a pair of discharge rollers 24 is disposed near the sheet discharge port 14.

The reverse conveyance passage 22B is provided between the outer surface of a reversing unit 25 and the inner surface of the rear cover 12 of the main body housing 10. The transfer rollers 34 and one of the pair of the registration rollers 23 are mounted on the inner surface of the reversing unit 25. The rear cover 12 and the reversing unit 25 are each rotatable around a fulcrum 121 provided at their lower ends. In a case where a sheet jam occurs in the reverse conveyance passage 22B, the rear cover 12 is opened. In a case where a sheet jam occurs in the main conveyance passage 22F or in a case where a unit supporting the photoreceptor drum 31 or the developing device 33 needs to be taken out, the reversing unit 25 is opened in addition to the rear cover 12.

Figure 5:
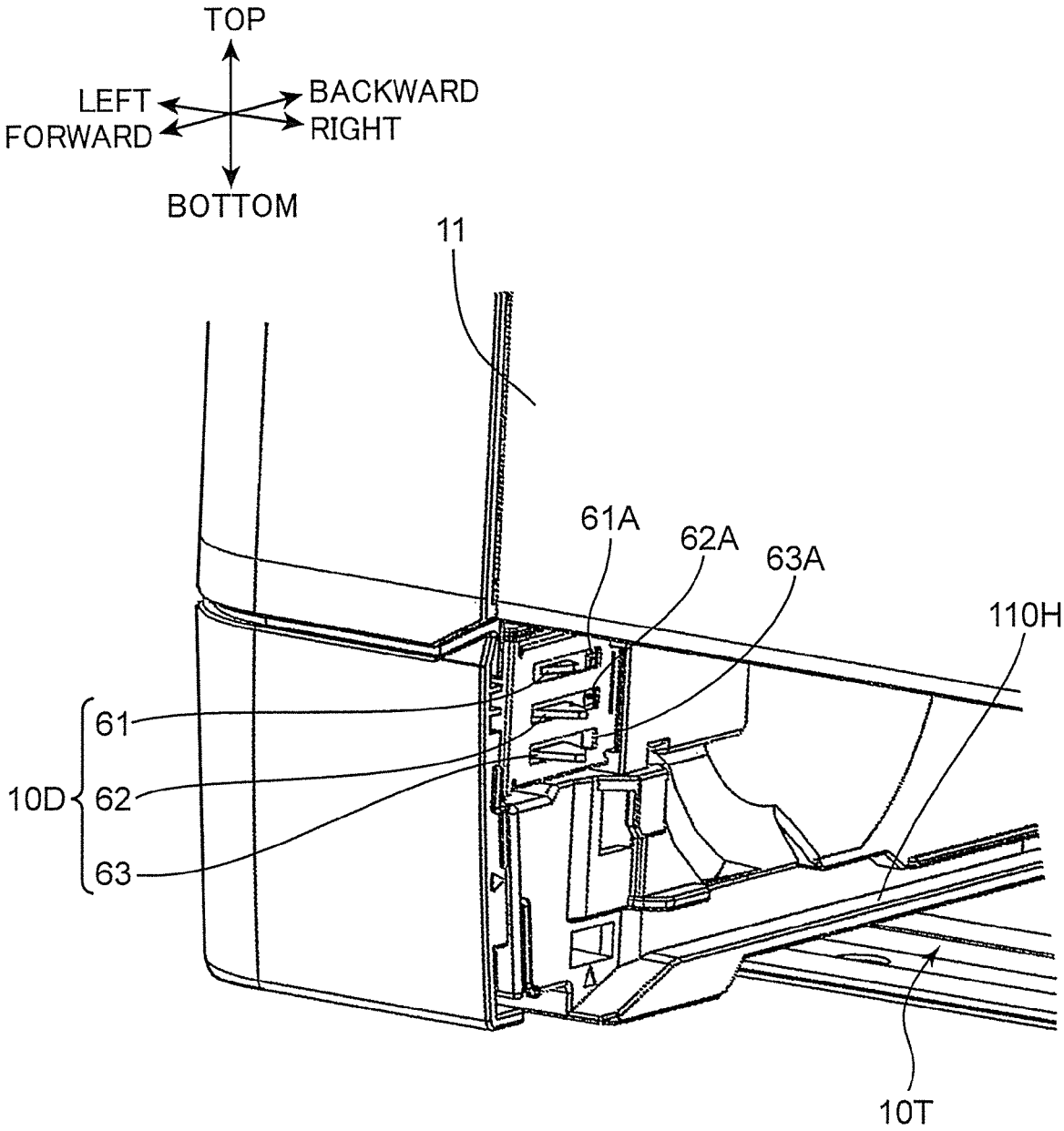
FIG. 5 is an enlarged perspective view of a part of the apparatus shown in FIG. 2.
Figure 6:
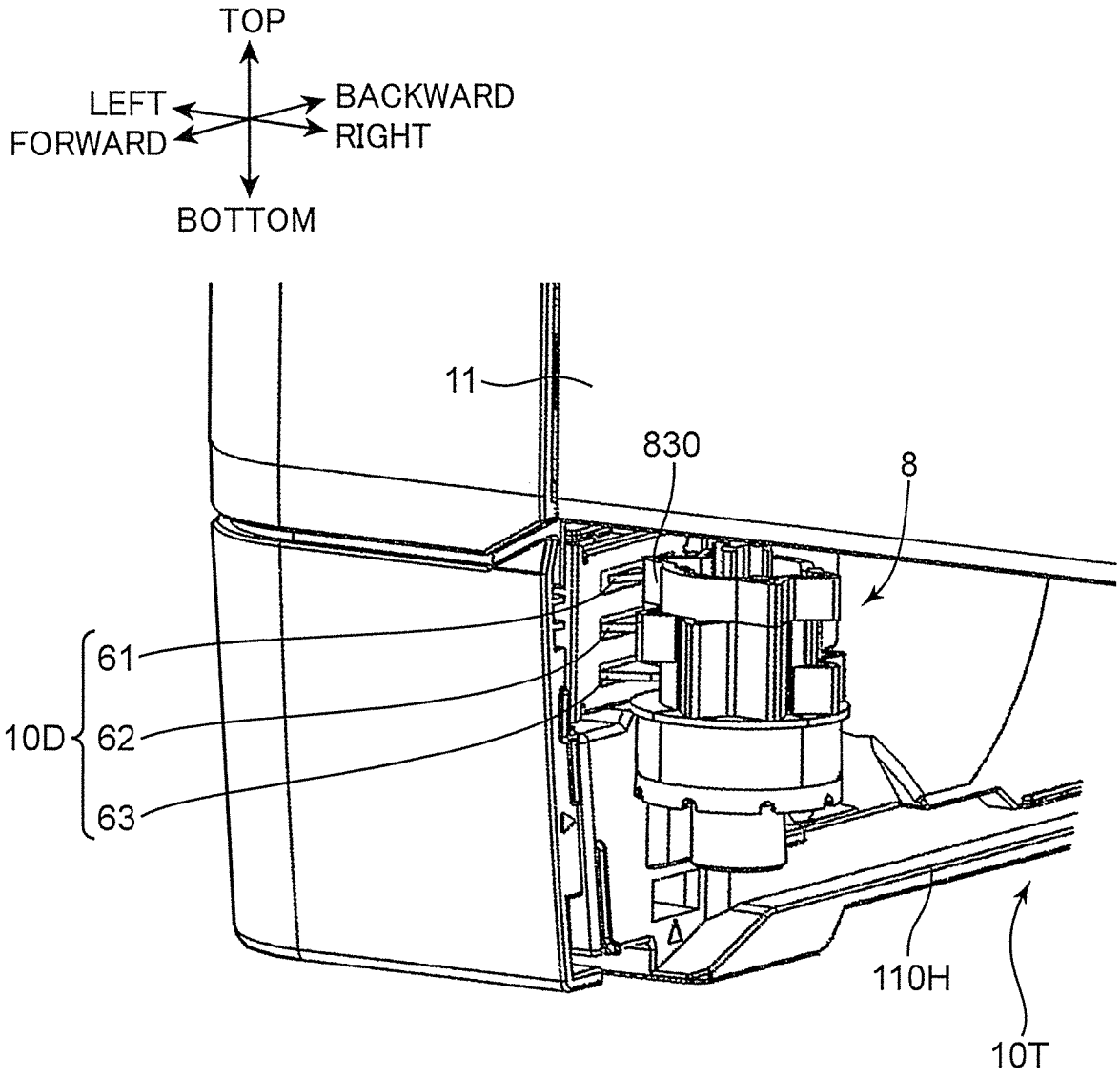
FIG. 6 is a perspective view similar to that shown in FIG. 5, but with a first rotary member added.
Figure 7:
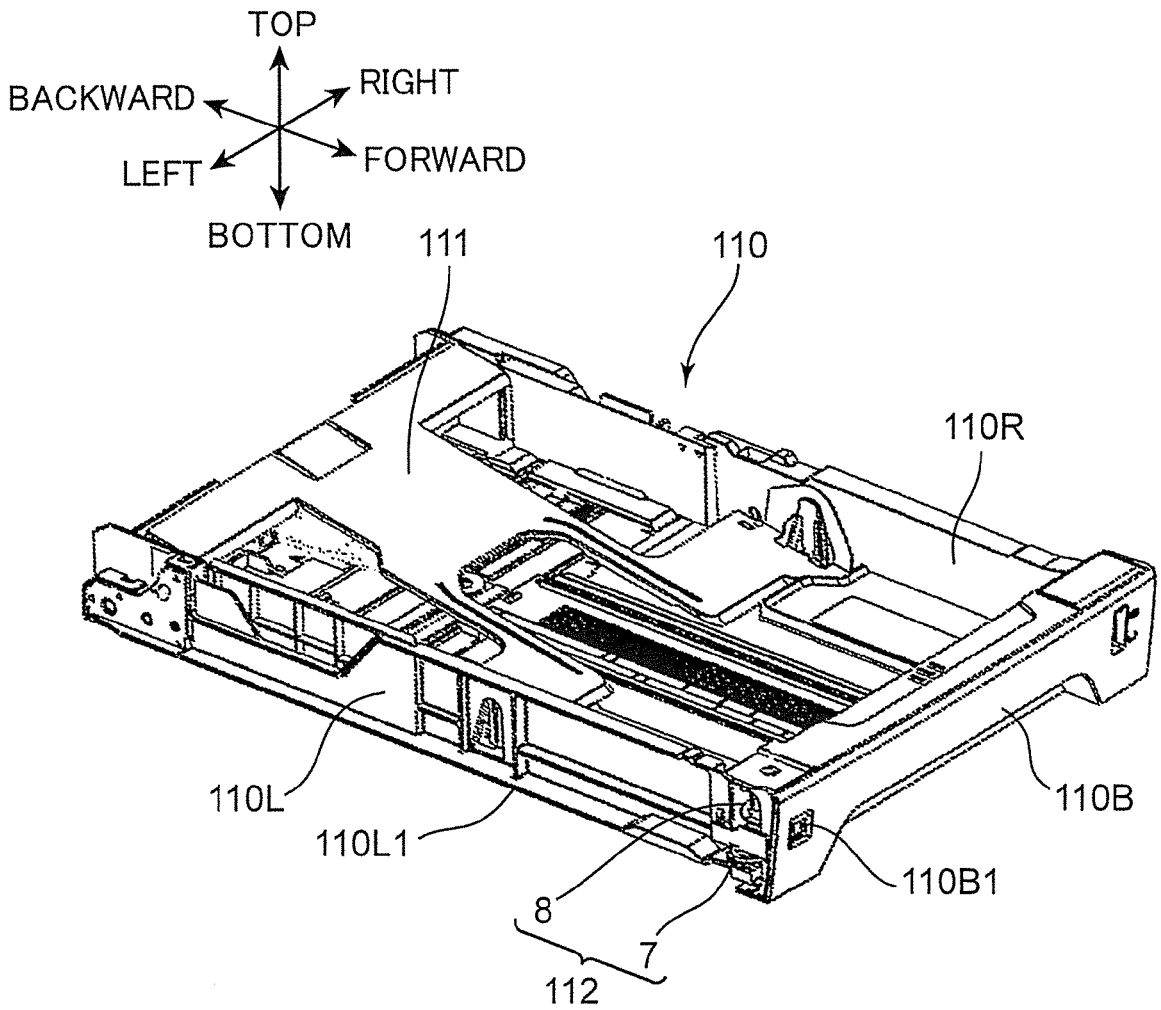
FIG. 7 is a perspective view of the sheet feeding cassette according to the first embodiment of the present disclosure.
Figure 8:
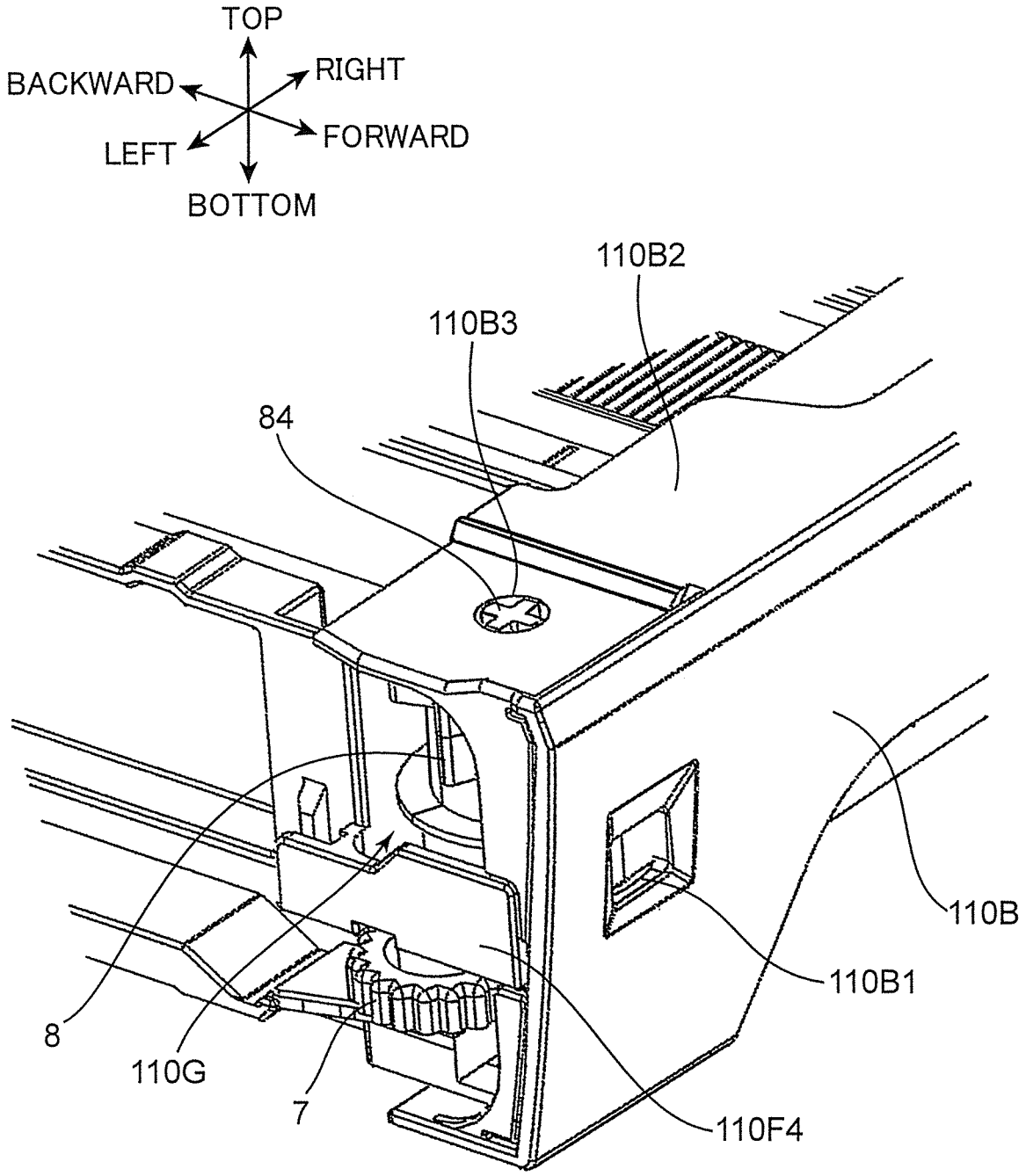
FIG. 8 is an enlarged perspective view of a part of the cassette shown in FIG. 7.
Figure 9:
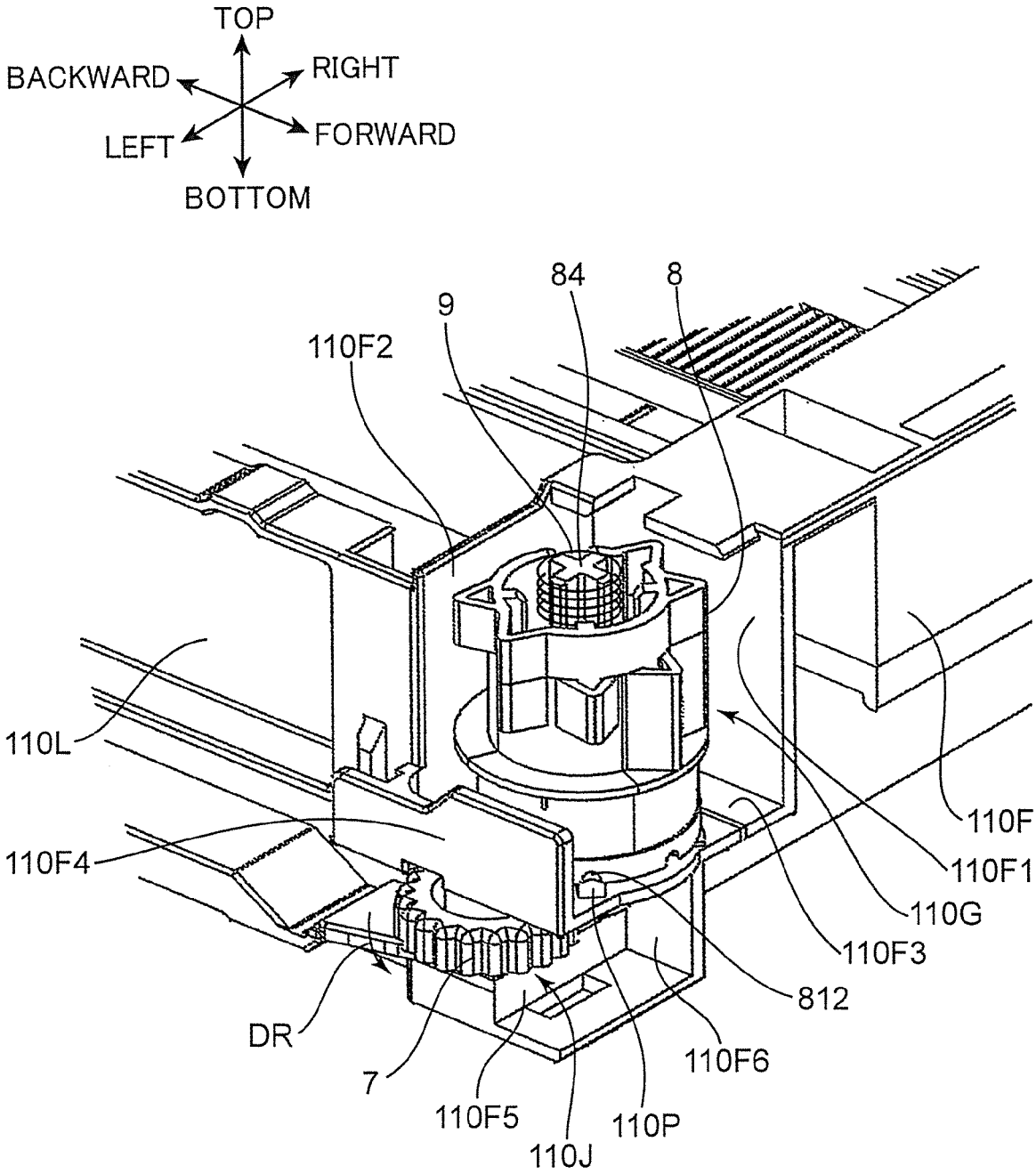
FIG. 9 is a perspective view showing the inside of the sheet feeding cassette shown in FIG. 8.
Figure 10:
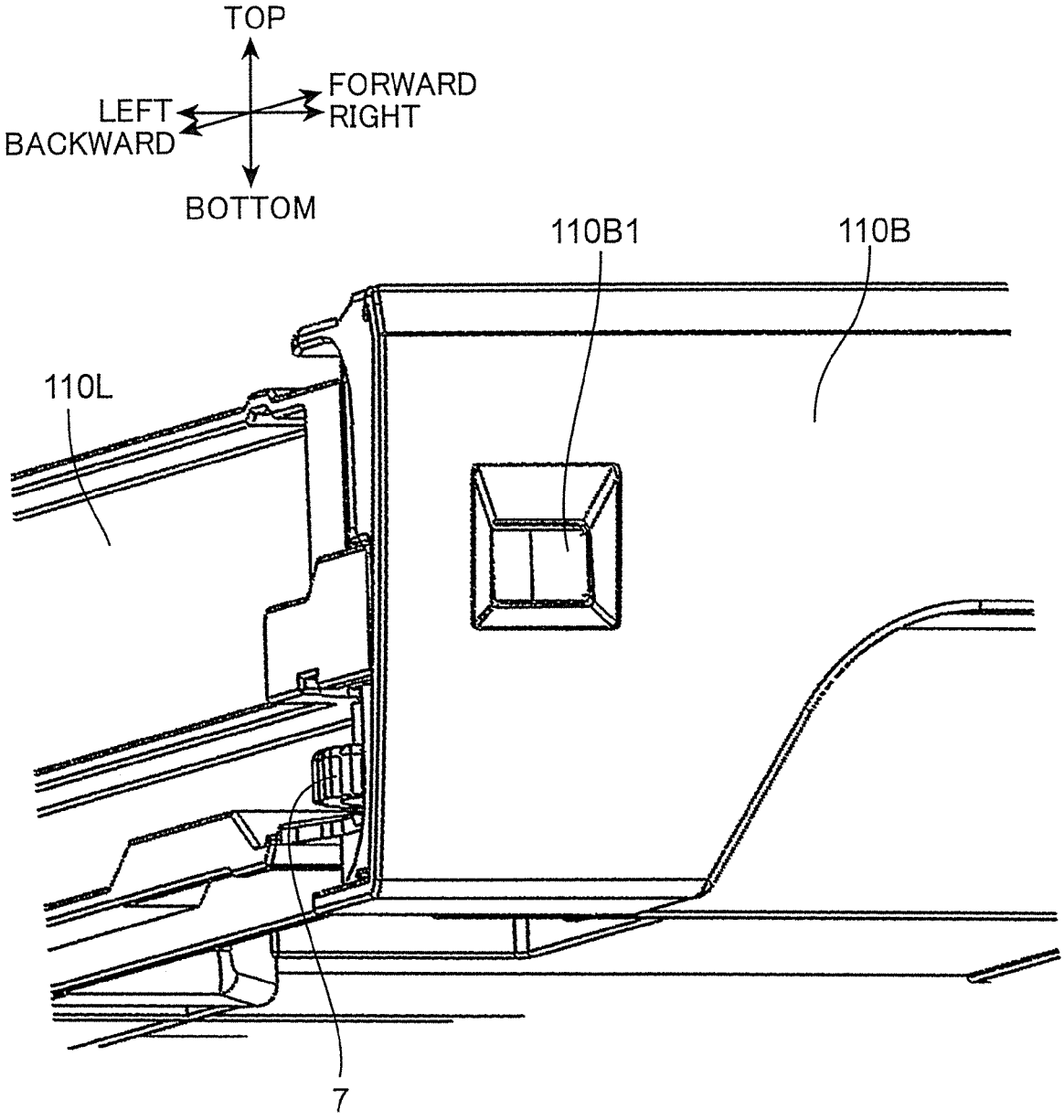
FIG. 10 is an enlarged perspective view of the sheet feeding cassette according to the first embodiment of the present disclosure.
Figure 11:
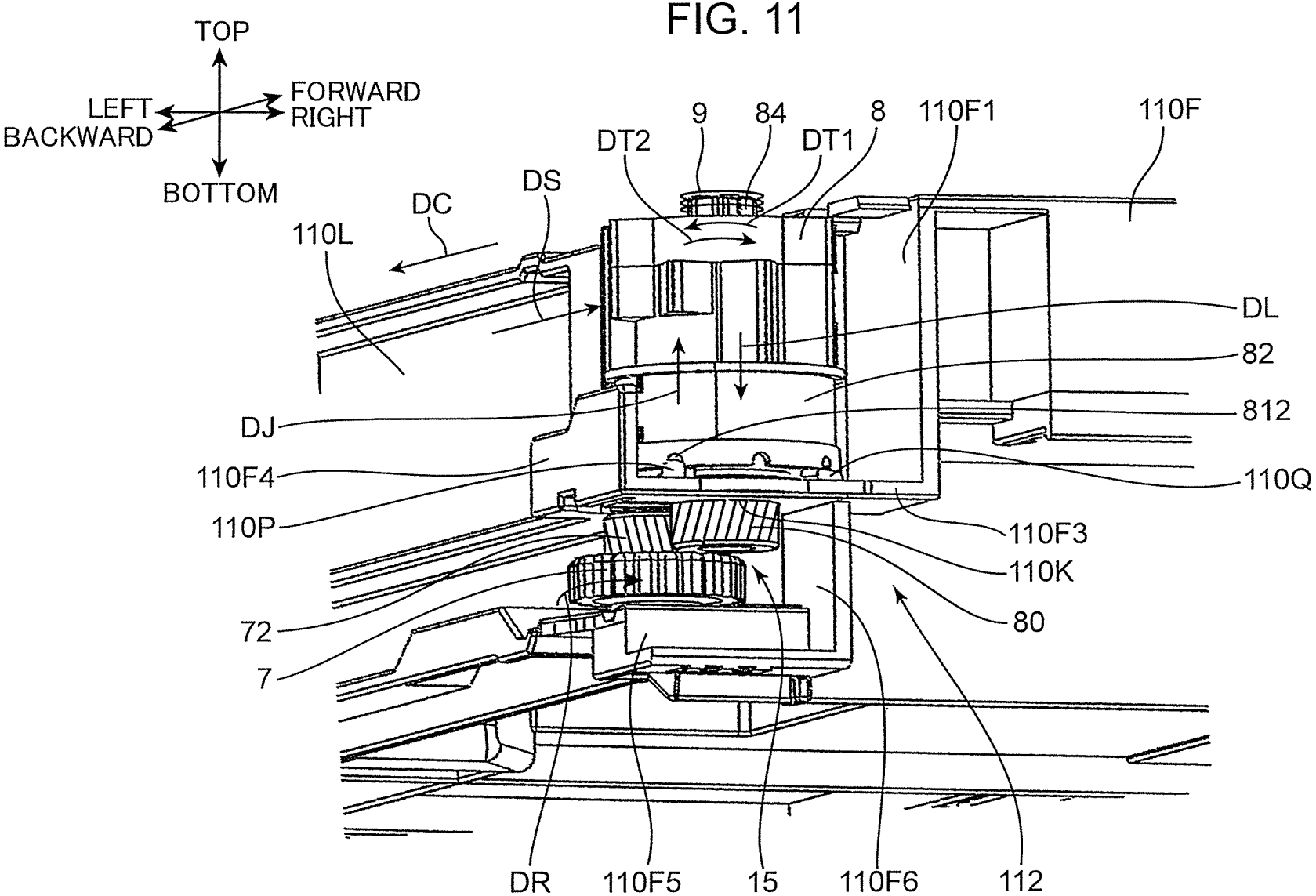
FIG. 11 is a perspective view showing the inside of the sheet feeding cassette shown in FIG. 10.
Figure 12:
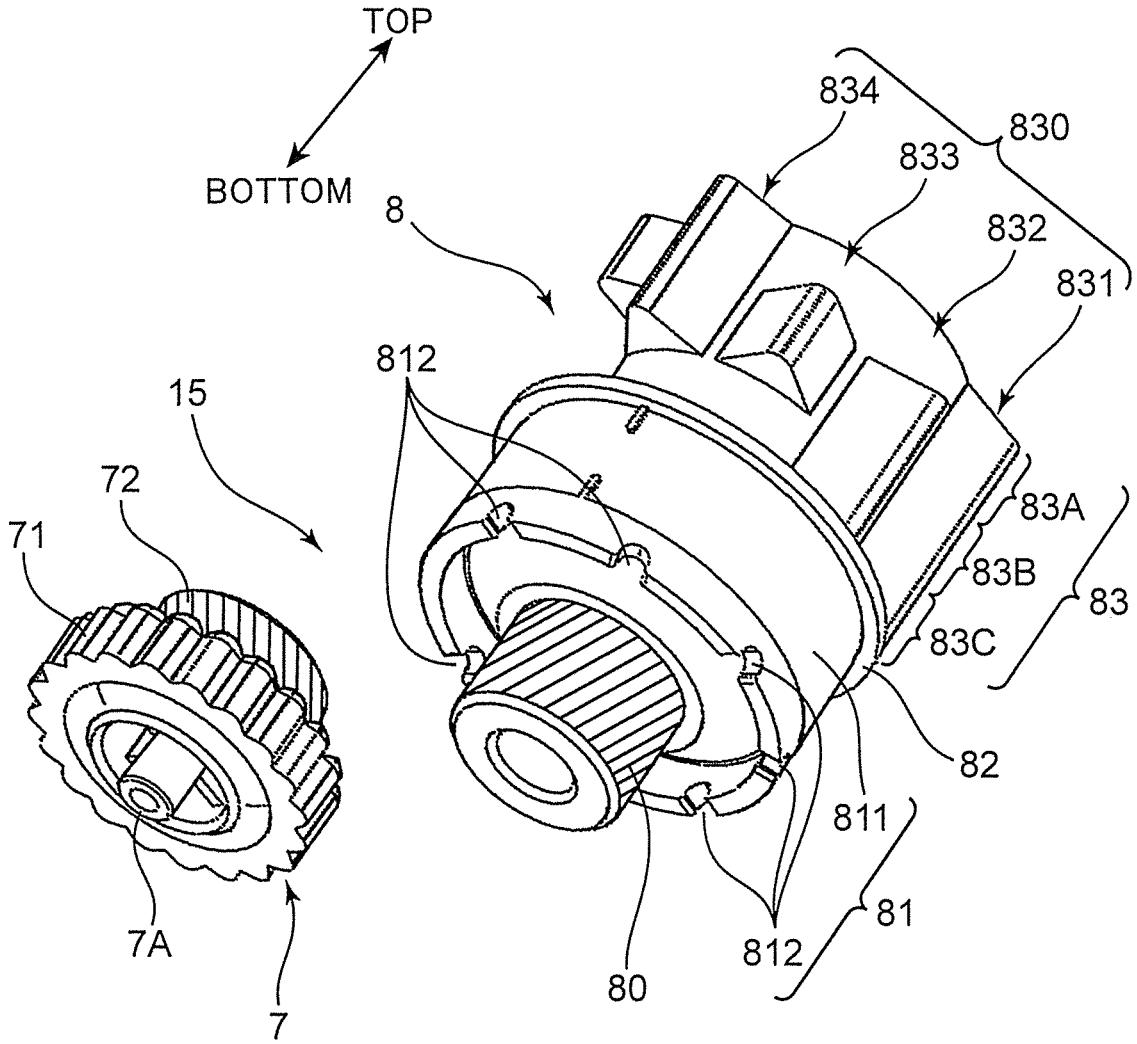
FIG. 12 is a perspective view of the first rotary member and a second rotary member according to the first embodiment of the present disclosure.
Figure 13:
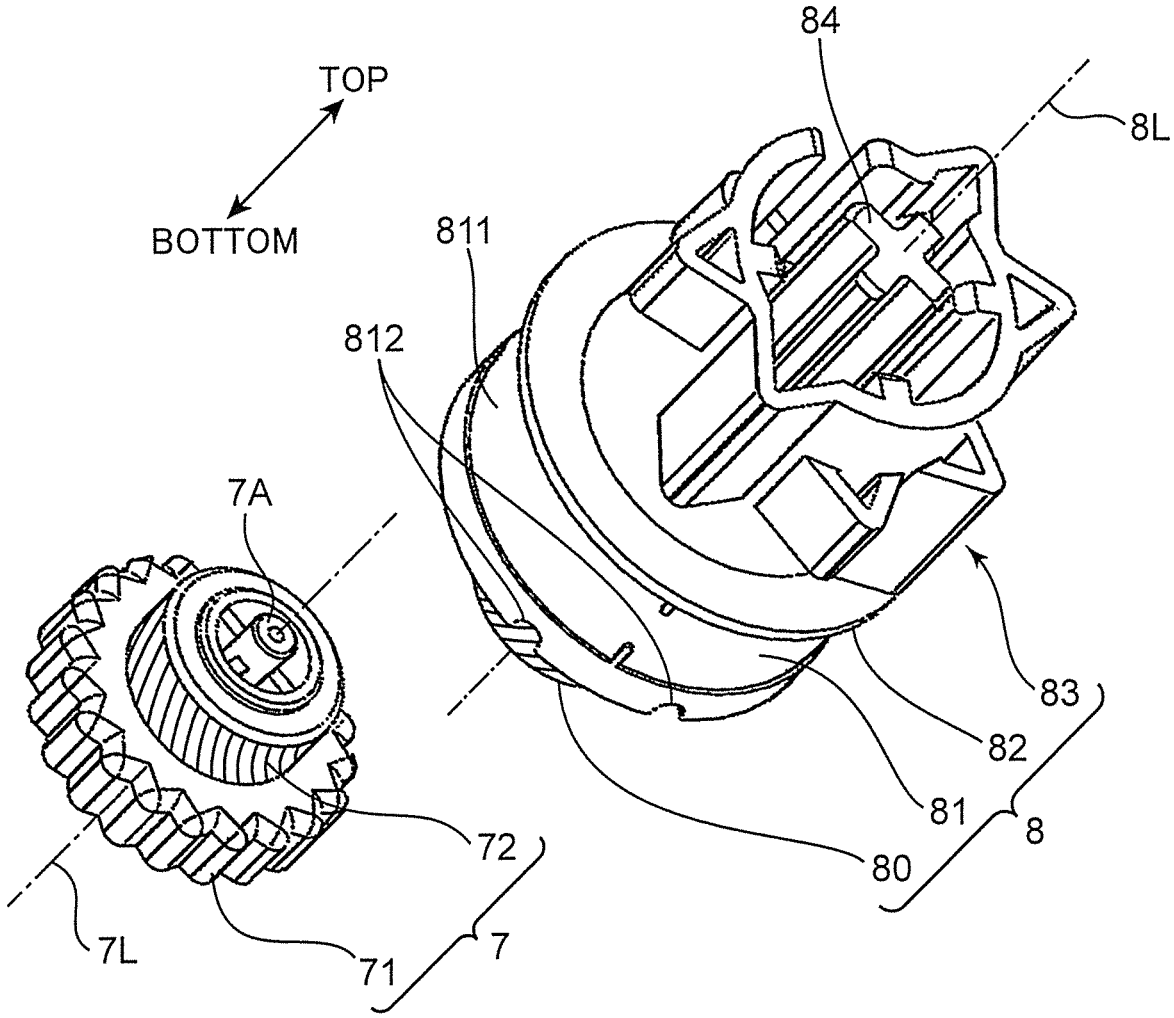
FIG. 13 is a perspective view of the first rotary member and the second rotary member according to the first embodiment of the present disclosure.

Now a structure for detecting a size of sheets S stored in the cassette 110 will be described as a first embodiment of the present disclosure, with reference to FIGS. 5 to 13 in addition to FIGS. 1 to 4. FIG. 5 is an enlarged perspective view of a part of the image forming apparatus 1 shown in FIG. 2. FIG. 6 is a perspective view of the cassette 110 similar to that shown in FIG. 5, but with a pressing unit 8 to be described later added. FIG. 7 is a perspective view of the cassette 110 according to the present embodiment. FIG. 8 is an enlarged perspective view of a part of the cassette shown in FIG. 7. FIG. 9 is a perspective view showing the inside of the cassette 110 shown in FIG. 8. FIG. 10 is an enlarge perspective view of the cassette 110. FIG. 11 is a perspective view showing the inside of the cassette 110 shown in FIG. 10. Each of FIGS. 12 and 13 is a perspective view of the pressing unit 8 and an operation dial 7 according to the present embodiment.

With reference to FIGS. 1 to 4, the cassette 110 is mountable to and dismountable from the main body housing 10 in the forward-backward direction. Specifically, the cassette 110 is mounted and dismounted to and from a cassette insertion section 10T (FIG. 2) which includes a space defined at a lower end of the main body housing 10. The cassette 110 includes a cassette bottom wall 110A (FIG. 4), a cassette front wall 110B (FIG. 4), a cassette rear wall 110C (FIG. 4), a cassette left wall 110L, and a cassette right wall 110R. The cassette bottom wall 110A constitutes the bottom of the cassette 110. The cassette front wall 110B is a front wall of the cassette 110 and is detachable from the cassette 110. The cassette rear wall 110C is a rear wall of the cassette 110. The cassette left wall 110L and the cassette right wall 110R are left and right side walls of the cassette 110. The cassette left wall 110L and the cassette right wall 110R respectively include a left rail 110L1 (FIG. 7) and a right rail 110R1 (FIG. 3) extending in the forward-backward direction. The cassette 110 is mounted to the main body housing 10 in a specific mounting direction directed rearward (see an arrow DC in FIG. 4). At this time, the right rail 110R1 and the left rail 110L1 of the cassette 110 are guided onto a pair of right and left cassette rails 110H (FIGS. 5 and 6) disposed in the main body housing 10 and extending in the forward-backward direction. FIGS. 5 and 6 show only the left cassette rail 110H of the pair of right and left cassette rails 110H.

With reference to FIGS. 5 to 7, the sheet feeding section 20 includes a size detection switch 10D (sheet size detector), and a sheet size setting device 112.

The size detection switch 10D is disposed on the main body housing 10. The size detection switch 10D detects a size of sheets S stored in the cassette 110 by detecting a detected portion 830 of the sheet size setting device 112 to be described later. With reference to FIGS. 5 and 6, the size detection switch 10D is disposed on a left inner wall of the main body housing 10 defining the cassette insertion section 10T. The size detection switch 10D is disposed above a front end of the left cassette rail 110H. The size detection switch 110D includes a plurality of contact switches each operable to move in and out in accordance with contact with the detected portion 830 to be described later (target object to be detected). Specifically, the size detection switch 10D includes a first switch 61, a second switch 62, and a third switch 63. The first switch 61, the second switch 62, and the third switch 63 project rightward from a first slit 61A, a second slit 62A and a third slit 63A, respectively, the slits being formed in the inner wall. Each of the switches is operable to retract into the corresponding slit owing to contact with the detected portion 830. This allows detection of a size of sheets S based on a predetermined pattern by a retract combination of the first switch 61, the second switch 62, and the third switch 63, via an unillustrated switch circuit.

The sheet size setting device 112 (FIG. 7) is disposed in the cassette 110. The sheet size setting device 112 functions to give information for identifying a size of sheets S stored in the cassette 110 to the size detection switch 10D. The sheet size setting device 112 is disposed on a front left corner of the cassette 110. Specifically, the cassette 110 includes a front frame 110F (housing) (FIG. 9). With reference to FIGS. 8 and 9, when the cassette front wall 110B is detached from the cassette 110, the front frame 110F is exposed. The front frame 110F joins the cassette left wall 110L and the cassette right wall 110R. The front frame 110F and the cassette front wall 110B function as a housing for supporting the sheet size setting device 112 (FIG. 11). The front frame 110F includes a first wall part 110F1, a second wall part 110F2, a first bottom part 110F3, a third wall part 110F4, a second bottom part 110F5, and a fourth bottom part 110F6.

The first wall part 110F1 is disposed behind the cassette front wall 110B and extends in the forward-backward direction. The first wall part 110F1 is disposed on the right side of the cassette left wall 110L with a space therebetween. The second wall part 110F2 is disposed perpendicularly to the first wall part 110F1 and the cassette left wall 110L to extend in the right-left direction. The second wall part 110F2 is disposed behind the cassette front wall 110B with a space therebetween. The first bottom part 100F3 is a wall disposed at a substantially vertical center of the cassette 110 and extending in the forward-backward and right-left directions. The first wall part 110F3 connects the lower end of the first wall part 110F1 and the lower end of the second wall part 110F2. The third wall part 110F4 is a wall extending upward from the left end of the first bottom part 110F. The third wall part 110F4 extends in the forward-backward direction along the cassette left wall 110L. The second wall part 110F5 is disposed below the first bottom part 110F3 with a space therebetween. The second wall part 110F5 has a flat substantially rectangular shape. The fourth wall part 110F6 joins the right end of the second wall part 110F5 and extends vertically. The upper end of the fourth wall part 110F6 joins the first bottom part 110F3.

As shown in FIG. 9, there is provided a unit mounting section 110G (first mounting section) having a substantially rectangular shape, the unit mounting section being defined above the first bottom part 110F3, on the left side of the first wall part 110F1 and in front of the second wall part 110F2. The unit mounting section 110G has a space (first space) where the pressing unit 8 to be described later is placed. On the other hand, there is provided a dial mounting section 110J (second mounting section) adjacent to the unit mounting section 110G, the dial mounting section being defined between the first bottom part 110F3 and the second bottom part 110F5. The dial mounting section 110J has a space (second space) where the operation dial 7 to be described later is placed. The above-described first bottom part 110F3 divides the first space of the unit mounting section 110G from the second space of the dial mounting section 110J. The first bottom part 110F3 is formed with a bearing opening 110K (FIG. 11).

The cassette 110 further includes a size indication part 110B1 (window), a front wall top plate 110B2, and a front wall hole 110B3 (FIG. 8). The size indication part 110B1 includes an opening formed at the left end of the cassette front wall 110B. The size indication part 110B1 allows communication between the outside of the cassette 110 and the unit mounting section 110G. The size indication part 110B1 allows a sheet size indication member 811 to be exposed to the outside in correspondence with rotation of the pressing unit 8 to be described later. Consequently, it is possible for a user of the sheet feeding section 20 (image forming apparatus 1) to see a size of sheets S that are to be stored.

The front wall top plate 110B2 extends rearward from the upper end of the cassette front wall 110B. The left end of the front wall top plate 110B2 defines the top of the unit mounting section 110G as shown in FIG. 8. In other words, the front wall top plate 110B2 defines one end of the first space of the unit mounting section 110G in an axial direction (a direction extending along a unit axis 8L) of the pressing unit 8 to be described later. On the other hand, the above-described first bottom part 110F3 is disposed oppositely to the front wall top plate 110B2 to define the other end of the first space of the unit mounting section 110G in the axial direction of the pressing unit 8. The front wall top plate 110B2 is supporting the pressing unit 8 with the first bottom part 110F3 rotatably. The front wall hole 110B3 is formed at the left end of the front wall top plate 110B2. The front wall hole 110B3 vertically extends through the front wall top plate 110B2. The front wall hole 110B3 allows a unit upper end shaft 84 of the pressing unit 8 to be described later to pass therethrough.

The sheet size setting device 112 includes, in addition to the above-described front frame 110F and the cassette front wall 110B (housing), the operation dial 7 (FIG. 9) (second rotary member), the pressing unit 8 (first rotary member), a spring 9 (biasing member), an engagement protrusion 110P (engaging portion), and supporting protrusions 110Q (FIG. 11).

The operation dial 7 is disposed under the third wall part 110F4 and between the first bottom part 110F3 and the second bottom part 110F5, as described above. With reference to FIGS. 12 and 13, the operation dial 7 is in the shape of cylinders having a step. The operation dial 7 includes a dial shaft 7A, an operation portion 71 (disk portion, dial), and a dial gear 72 (second gear portion).

The dial shaft 7A has an axis around which the operation dial 7 rotates. The dial shaft 7A vertically projects from the operation dial 7. The operation portion 71 is disposed at a lower part of the operation dial 7 and has a disk shape. The operation portion 71 is rotated around the dial shaft 7A of the operation dial 7 by a user to rotate the dial gear 72. Therefore, the circumferential surface of the operation portion 71 has irregularities for improving operability. The dial gear 72 is a gear portion disposed around the dial shaft 7A. The dial gear 72 is coupled (engaged) with a unit gear 80 of the pressing unit 8 to be described later. The operation dial 7 is rotated in a specific direction (an arrow DR in FIG. 11) around the dial shaft 7A to rotate the pressing unit 8 to set a size of sheets S.

The upper end of the dial shaft 7A passes through an unillustrated bearing opening formed in the first bottom part 110F3. In the similar manner, the lower end of the dial shaft 7A passes through an unillustrated bearing opening formed in the second bottom part 110F5. Consequently, a dial axis 7L (second axis) (FIG. 13) is established as shown in FIG. 13. The operation dial 7 is disposed in the dial mounting section 110J and supported on the front frame 110F rotatably around the dial axis 7L (see FIG. 11). In addition, as shown in FIG. 8, a part of a circumferential portion of the operation portion 71 of the operation dial 7 projects leftward with respect to the third wall part 110F4, thereby allowing a user operating the image forming apparatus 1 to easily rotate the operation dial 7.

The pressing unit 8 is a cylindrical rotary member which is rotatably supported on the front frame 110F at both ends. The pressing unit 8 is rotated by the operation dial 7 to give information for identifying a size of sheets S to the size detection switch 10D. With reference to FIGS. 12 and 13, the pressing unit 8 includes the unit gear 80 (first gear), a unit indicator 81, a flange 82, a pressing portion 83, and the unit upper end shaft 84.

The unit gear 80 is disposed at a lower part of the pressing unit 8. The unit gear 80 is a gear portion engaged with the dial gear 72. Therefore, the unit gear 80 passes through the bearing opening 110K of the first bottom part 110F3 (FIG. 11). The unit gear 80 passing through the bearing opening 110K receives a driving force for rotation around a unit axis 8L to be described later from the dial gear 72. This allows the pressing unit 8 to rotate around the unit axis 8L. In the present embodiment, the unit gear 80 has an outer diameter equal to that of the above-described dial gear 72. In other words, a gear ratio of the rotational driving force transmission from the dial gear 72 to the unit gear 80 is set at 1.

The unit indicator 81 is a cylinder portion disposed above the unit gear 80. The unit indicator 81 has a larger diameter than the unit gear 80. The unit indicator 81 includes sheet size indication members 811, and engagement concave portions 812 (engaged portions). The sheet size indication members 811 are disposed in an upper part of the unit indicator 81 (in the second region of the pressing unit 8). Although FIGS. 12 and 13 do not show explicitly, the sheet size indication members 811 are rectangular indication members disposed on the circumferential surface in the circumferential direction of the unit indicator 81, corresponding to different sizes of sheets S. In other words, the sheet size indication members 811 are indicia in divisions of the circumferential surface of the unit indicator 81 in the circumferential direction to indicate different sizes of sheets S. Each of the sheet size indication members 811 is provided with an indication showing a size of sheets S. For example, the sheet size indication members 811 have respective indications "A4", "A3" and "B5". The engagement concave portions 812 are formed in the lower end of the unit indicator 81. The engagement concave portions 812 are cutouts formed in the end surface of the pressing unit 8 in the circumferential direction in such a way as to correspond to a plurality of detected portions 830. The engagement concave portions 812 are formed by cutting out parts of the lower end of the unit indicator 81 upwardly. The plurality of engagement concave portions 812 can be selectively engaged with the engagement protrusion 110P to be described later.

The flange 82 is disposed above the unit indicator 81. The flange 82 has a diameter slightly larger than that of the unit indicator 81.

The pressing portion 83 is disposed at an upper end of the pressing unit 8. The pressing portion 83 has a substantially cylindrical shape. The pressing portion 83 presses each of the above-described switches of the size detection switch 10D. The pressing portion 83 includes a first pressing zone 83A, a second pressing zone 83B, and a third pressing zone 83C corresponding to the three switches (FIG. 12). The first pressing zone 83A has a part operable to come into contact with the first switch 61 to thereby press the first switch 61. Similarly, the second pressing zone 83B has a part operable to come into contact with the second switch 62 to thereby press the second switch 62. Further, the third pressing zone 83C has a part operable to come into contact with the third switch 63C to thereby press the third switch 63C. The first pressing zone 83A, the second pressing zone 83B, and the third pressing zone 83C each includes a plurality of protrusions having a triangular shape in plan view in the circumferential direction of the pressing portion 83. In other words, the pressing portion 83 includes the detected portions 830 (FIG. 12).

The detected portions 830 each includes a protrusion having a different length in the axial direction over the first pressing zone 83A, the second pressing zone 83B, and the third pressing zone 83C, the protrusions being disposed in the circumferential direction. The detected portion 830 is detected by the size detection switch 10D as a target object that allows detection of a size of sheets S. The detected portions 830 extending in the axial direction form irregularity patterns in the axial direction to allow the plurality of contact switches of the size detection switch 10D to identify a sheet size. For example, the detected portions 830 include a first detected portion 831, a second detected portion 832, a third detected portion 833, and a fourth detected portion 834. As shown in FIG. 12, the first detected portion 831 includes a protrusion extending over all of the first pressing zone 83A, the second pressing zone 83B, and the third pressing zone 83C. The second detected portion 832 includes a protrusion extending over the second pressing zone 83B and the third pressing zone 83C. The third detected portion 833 includes a protrusion extending over the second pressing zone 83B, and the fourth detected portion 834 includes a protrusion extending over the first pressing zone 83A and the second pressing zone 83B. Therefore, one of the detected portions 830 is caused to press the size detection switch 10D with rotation of the pressing unit 8, which allows detection of different sizes of sheets S. The sheet size indication members 811 and the engagement concave portions 812 correspond to the detected portions 830 in the axial direction.

The unit upper end shaft 84 extends upward from the inside of the cylindrical pressing portion 83 (FIG. 13). The unit upper end shaft 84 constitutes a part of a rotation axis of the pressing unit 8. In other words, there is a unit axis 8L (first axis) passing between the unit upper shaft 84 and the unit gear 80. The unit axis 8L extends in parallel to the above-mentioned dial axis 7L. The unit axis 8L is extending to the space of the dial mounting section 110J in the space of the unit mounting section 110G. The pressing unit 8 is disposed in the unit mounting section 110 and supported on the front frame 110F rotatably around the unit axis 8L. Further, the pressing unit 8 is supported so as to be slidably movable along the unit axis 8L. In other words, the pressing unit 8 can be said to include a first region, a second region, and a third region along the unit axis 8L. In the present embodiment, the pressing section 83 is disposed in the first region, the engagement concave portions 812 are disposed in the second region, and the unit gear 80 is disposed in the third region.

The engagement protrusion 110P (FIGS. 9 and 10) is fixedly provided on the first bottom part 110F3 of the front frame 110F. The engagement protrusion 110P projects upward from the front left end of the first bottom part 110F3. The engagement protrusion 110P has a mountain shape having a ridge line extending in a radial direction of rotation of the pressing unit 8 (see an engagement protrusion 110PX in FIG. 14). The length of the ridge line of the engagement protrusion 110P is substantially equal to the radial width of the concave portion 812. In a state where the pressing unit 8 is mounted on the front frame 110F, the engagement protrusion 110P faces the engagement concave portion 812 under the unit indicator 81. The engagement protrusion 110P engages with one of the plurality of engagement concave portions 812 in the rotation of the pressing unit 8 around the unit axis 8L. The engagement between the engagement protrusion 110P and the engagement concave portion 812 allows a rotation position of the pressing unit 8 to be regulated. The supporting protrusions 110Q (FIG. 11) are disposed under the unit indicator 81 and spaced apart from the engagement protrusion 110P in the circumferential direction of the unit indicator 81. The supporting protrusion 110Q projects from the first bottom part 110F3 in the same manner as the engagement protrusion 110P. The supporting protrusion 110Q extends longer than the engagement protrusion 110P in the circumferential direction to have a planar top surface. The supporting protrusion 110Q functions to support the pressing unit 8 without engaging with the engagement concave portion 812. Although FIG. 11 does not show, there are the plurality of supporting protrusions 110Q disposed in the circumferential direction.

With reference to FIGS. 11 and 12, the above-described first bottom part 110F3 is formed with an unillustrated opening corresponding to the outer diameter of the unit gear 80. The unit gear 80 of the pressing unit 8 is inserted into the opening from above, and the unit indicator 81 of the pressing unit 8 is supported by the engagement protrusion 110P and the supporting protrusions 110Q. At this time, the pressing unit 8 is supported at a plurality of positions in the circumferential direction thereof and thereby prevented from inclining with respect to the unit axis 8L.

The spring 9 is disposed between the front wall top plate 110B2 and the pressing unit 8 and biases the pressing unit 8 in a direction of permitting the engagement concave portion 812 to engage with the engagement protrusion 110P. Specifically, as shown in FIG. 9, the spring 9 is fitted onto the unit upper shaft 84 of the pressing unit 8. The spring 9 is compressedly disposed between the bottom surface of the front wall top plate 110B2 (FIG. 8) of the front frame 110F and the inside of an inner end wall (not illustrated) of the circumference of the cylindrical pressing section 83, the inner end wall lying on an extension of the flange 82. This allows the spring 9 to apply a downward biasing force to the pressing unit 8. This prevents, when one of the engagement concave portions 812 is engaged with the engagement protrusion 110P, the engagement concave portion 812 from disengaging from the engagement protrusion 110P.

With reference to FIGS. 10 and 11, in a state where the cassette front wall 110B, the operation dial 7, the pressing unit 8, and the spring 9 are mounted on the front frame 110F of the cassette 110, a user operating the image forming apparatus 1 is allowed to set a size of sheets S. The user rotates the operation dial 7 exposed to the left side of the cassette 110 in the arrow DR direction shown in FIG. 11, while seeing a size indicated by a sheet size indication member 811 that is exposed in the size indication part 110B1. The rotation of the operation dial 7 is transmitted from the dial gear 72 to the unit gear 80 to rotate the pressing unit 8 in an arrow DT1 direction shown in FIG. 11. At this time, one of the engagement concave portions 812 is already engaged with the engagement protrusion 110P, and furthermore the pressing unit 8 is biased downwardly by the biasing force of the spring 9 (see an arrow DL in FIG. 11). Accordingly, it will be seen that the user has to rotate the pressing unit 8 in the condition that the engagement concave portion 812 comes into frictional contact with the engagement protrusion 110P under the biasing force of the spring 9. Further, the spring 9 is required to have a strong elasticity in order to prevent the engagement concave portion 812 from disengaging from the engagement protrusion 110P when the cassette 110 is strongly pushed into the main body housing 10. In this case, the user has to generate much greater operational force to rotate the operation dial 7.

In order to solve this problem, in the present embodiment, the sheet size setting device 112 is provided with an assisting mechanism 15 (FIG. 11). The assisting mechanism 15 causes rotation of the operation dial 7 around the dial shaft 7A to impart a moving force to the pressing unit 8 in such an axial direction that the engagement concave portion 812 disengages from the engagement protrusion 110P against the biasing force of the spring 9. In the present embodiment, the assisting mechanism 15 includes the above-described unit gear 80 and the dial gear 72. As shown in FIGS. 11 to 13, the unit gear 80 and the dial gear 72 each is in the form of a helical gear having each tooth oblique to the axial direction thereof. With reference to FIG. 11, the dial gear 72 has oblique teeth which are inclined in such a direction (downward) as to permit the engagement concave portion 812 of the pressing unit 8 to engage with the engagement protrusion 110P as advancing in the rotational direction of the operation dial 7 (in the arrow DR direction). Similarly, the unit gear 80 has oblique teeth which are inclined in such a direction as to permit the engagement concave portion 812 of the pressing unit 8 to engage with the engagement protrusion 110P as advancing in the rotational direction of the pressing unit 8 (in the arrow DT1 direction) owing to the rotation of the operation dial 7.

The above-described dial gear 72 and the unit gear 80 allow, when a driving force for rotation is transmitted from the dial gear 72 to the unit gear 80 owing to rotation of the operation dial 7, their respective oblique teeth to engage with each other to thereby impart a moving force (thrust) to the pressing unit 8 in the axial direction. Specifically, the pressing unit 8 receives the moving force in an arrow DJ direction shown in FIG. 11 by the engagement between oblique teeth of the dial gear 72 and those of the unit gear 80. This allows the engagement concave portion 812 to easily disengage from the engagement protrusion 110P. Consequently, a user (worker) can set a size of sheets S at a reduced operational force. Further, when the operation dial 7 is not rotated by a user, the engagement concave portion 812 can be prevented from disengaging from the engagement protrusion 110P by the biasing force of the spring 9. This can prevent the pressing unit 8 from accidentally rotating when the cassette 110 is mounted. In this manner, an incorrect setting of a sheet size can be prevented.

After a user sets a size of sheets S, the cassette 110 is mounted to the main body housing 10 (in an arrow DC direction shown in FIG. 11) in a state where the engagement concave portion 812 is engaged with the engagement protrusion 110P. At this time, a certain detected portion 830 that faces left among the plurality of detected portions 830 (FIG. 12) comes into contact with the size detection switch 10D (FIG. 6). In the present embodiment, the certain detected portion 830 comes into contact with contact switches of the size detection switch 10D in the mounting direction of the cassette 110 (the arrow DC in FIG. 11). At this time, a reactive force occurs from the size detection switch 10D to the detected portion 830 in an arrow DS direction shown in FIG. 11. Therefore, the pressing unit 8 receives the reactive force in the direction (an arrow DT2 in FIG. 11) opposite to the direction of rotation for setting a size of sheets S (the arrow DT1 in FIG. 11). When the reactive force is about to cause the pressing unit 8 to rotate, the engagement between the unit gear 80 and the dial gear 72 prevents the rotation of the pressing unit 8. At this time, a greater force is applied to the engagement concave portion 812 in the direction of engagement with the engagement protrusion 110P (the arrow DL in FIG. 11) by the engagement between respective oblique teeth. Therefore, the engagement concave portion 812 can be more assuredly prevented from disengaging from the engagement protrusion 110P in the mounting of the cassette 110.

Figure 14:
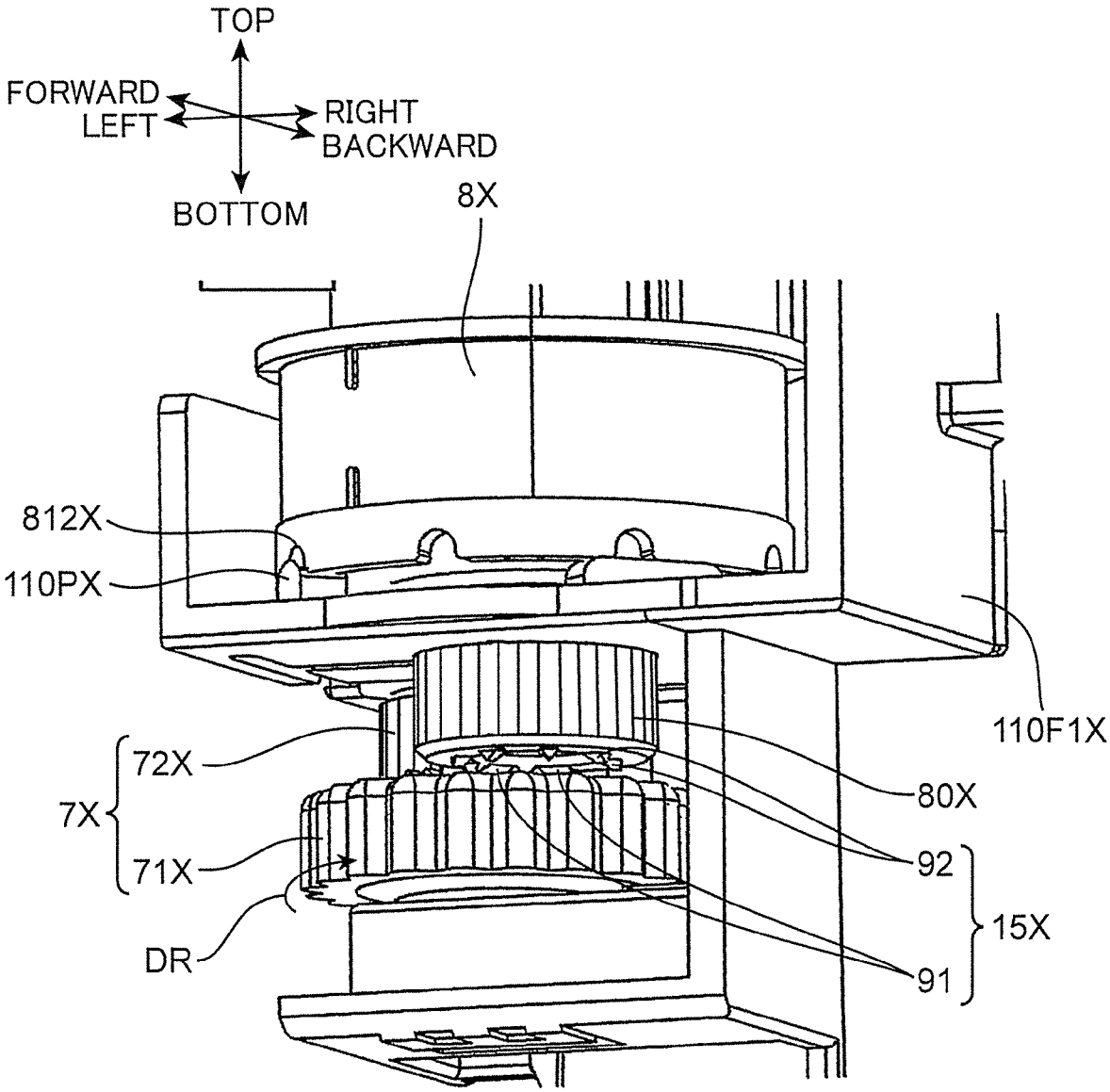
FIG. 14 is an enlarged perspective view showing the inside of a sheet feeding cassette according to a second embodiment of the present disclosure.
Figure 15:
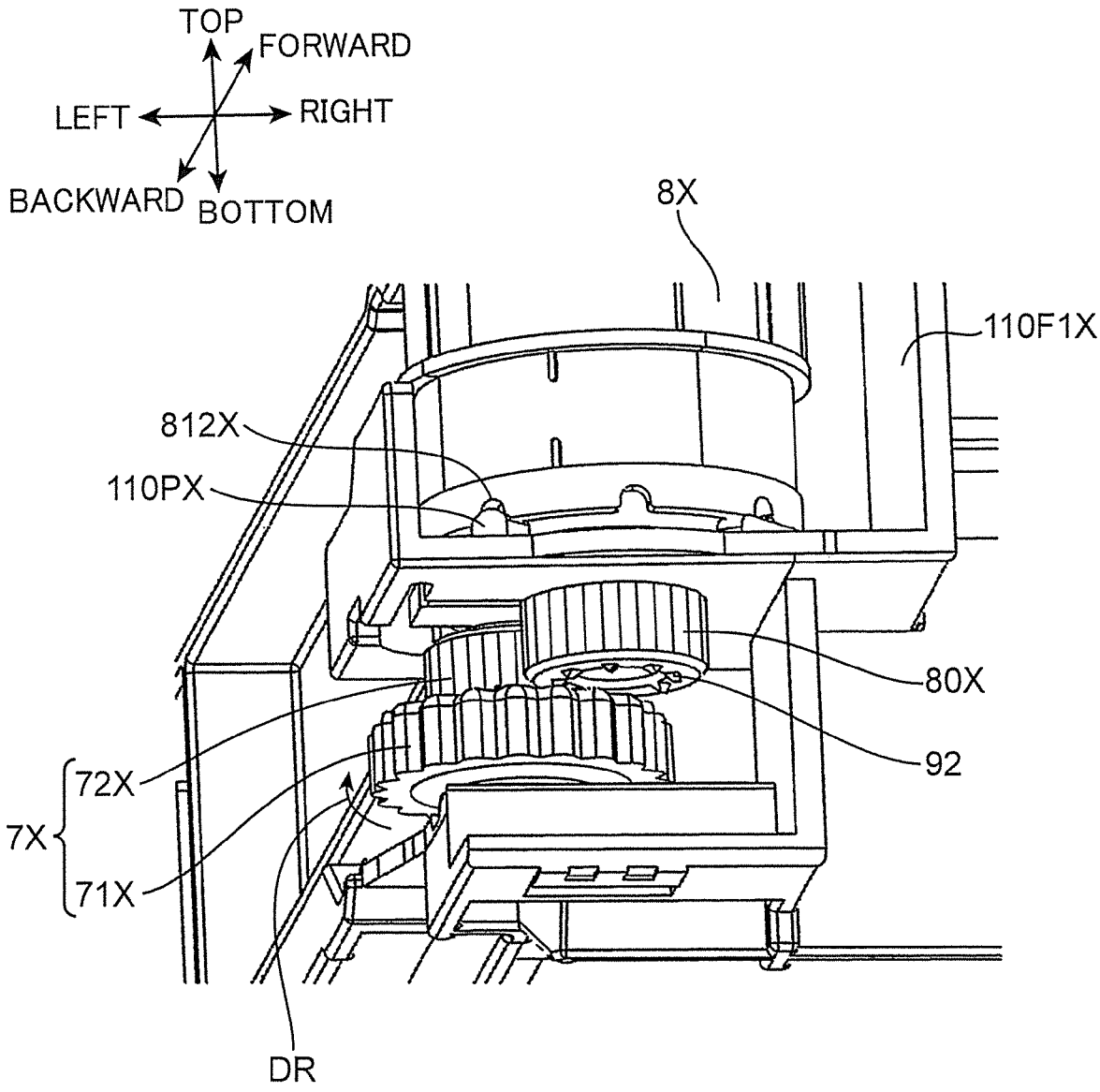
FIG. 15 is an enlarged perspective view showing the inside of the sheet feeding cassette according to the second embodiment of the present disclosure.
Figure 16:
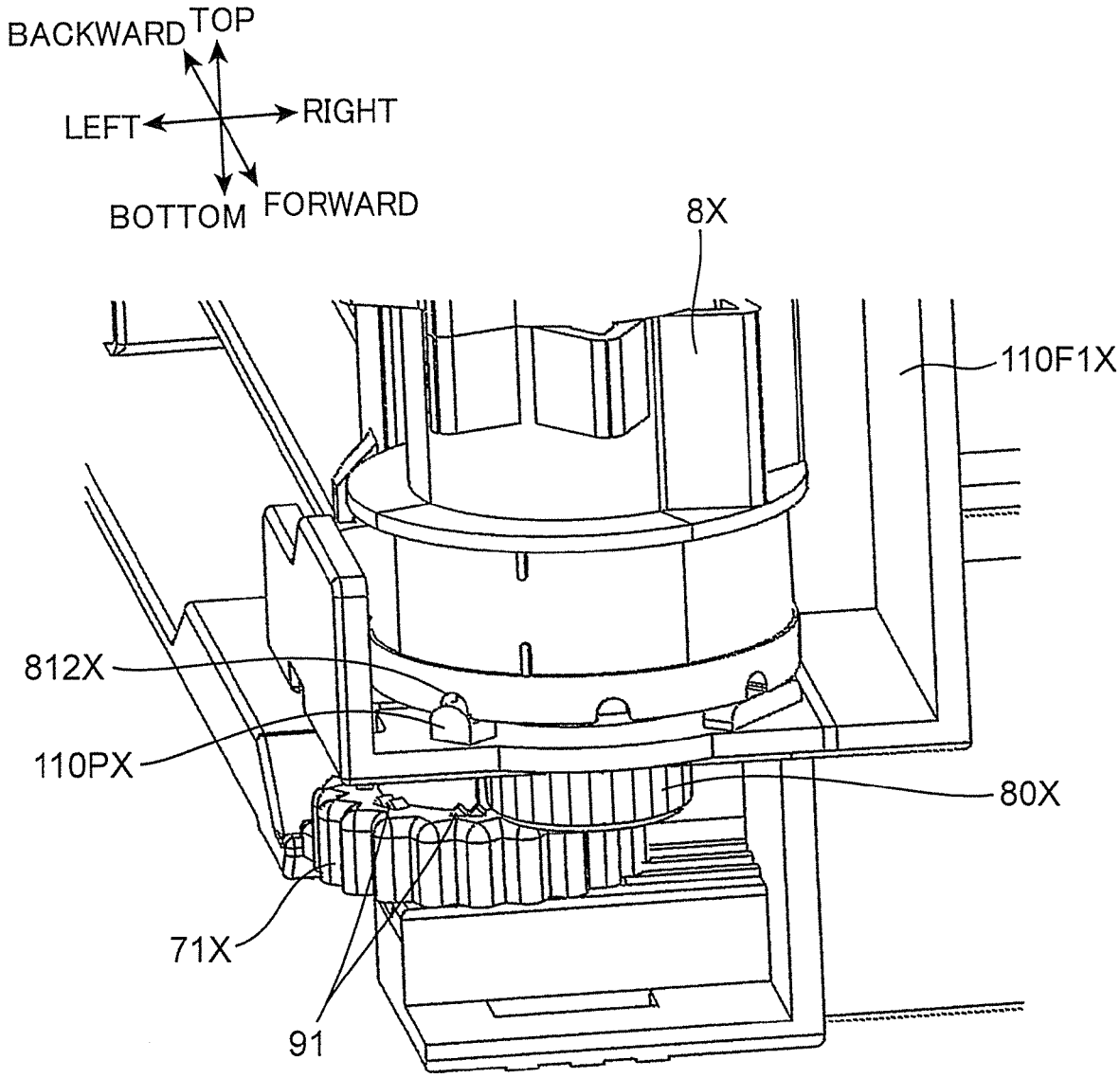
FIG. 16 is an enlarged perspective view showing the inside of the sheet feeding cassette according to the second embodiment of the present disclosure.
Figure 17:
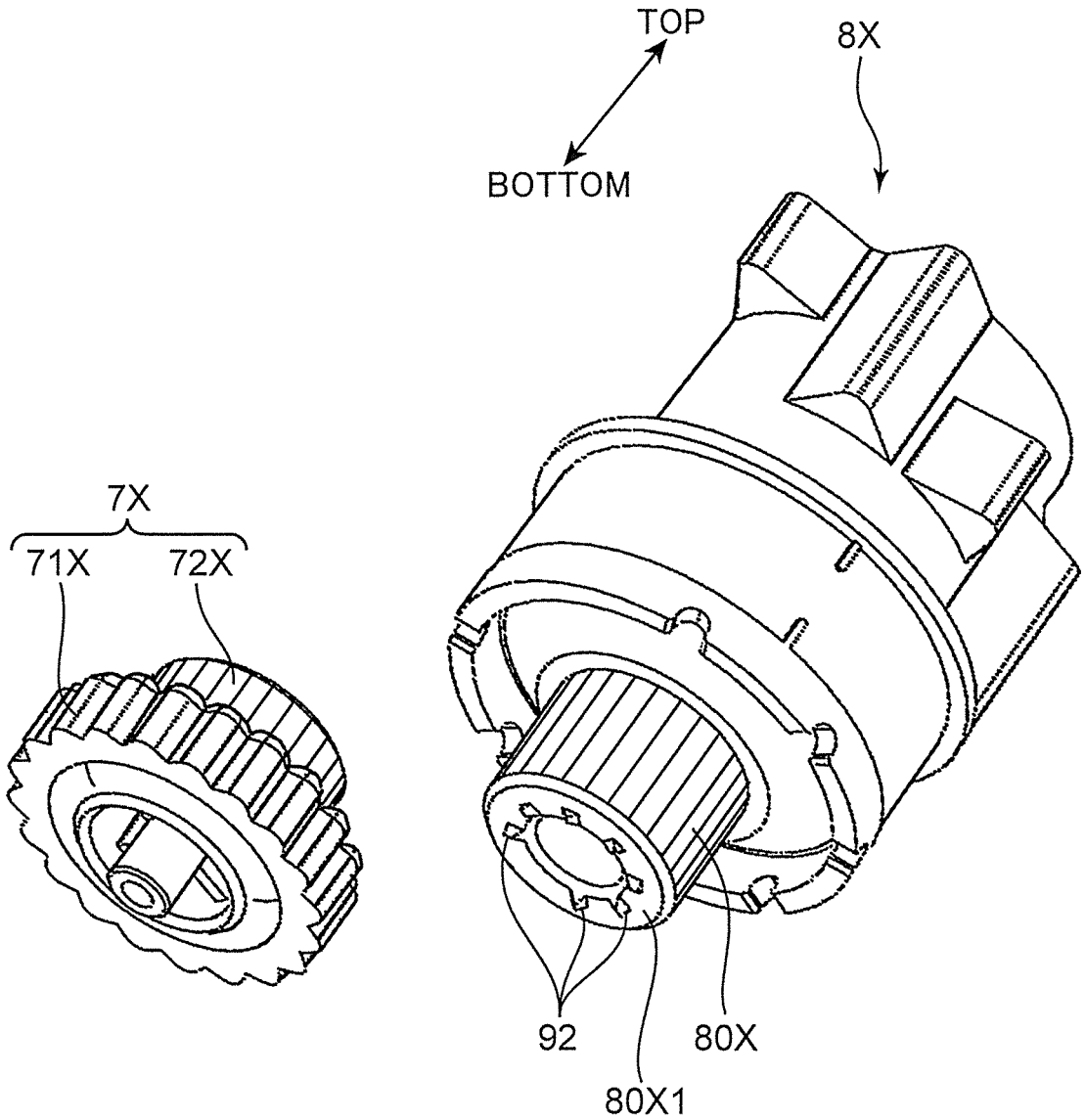
FIG. 17 is a perspective view of a first rotary member and a second rotary member according to the second embodiment of the present disclosure.
Figure 18:
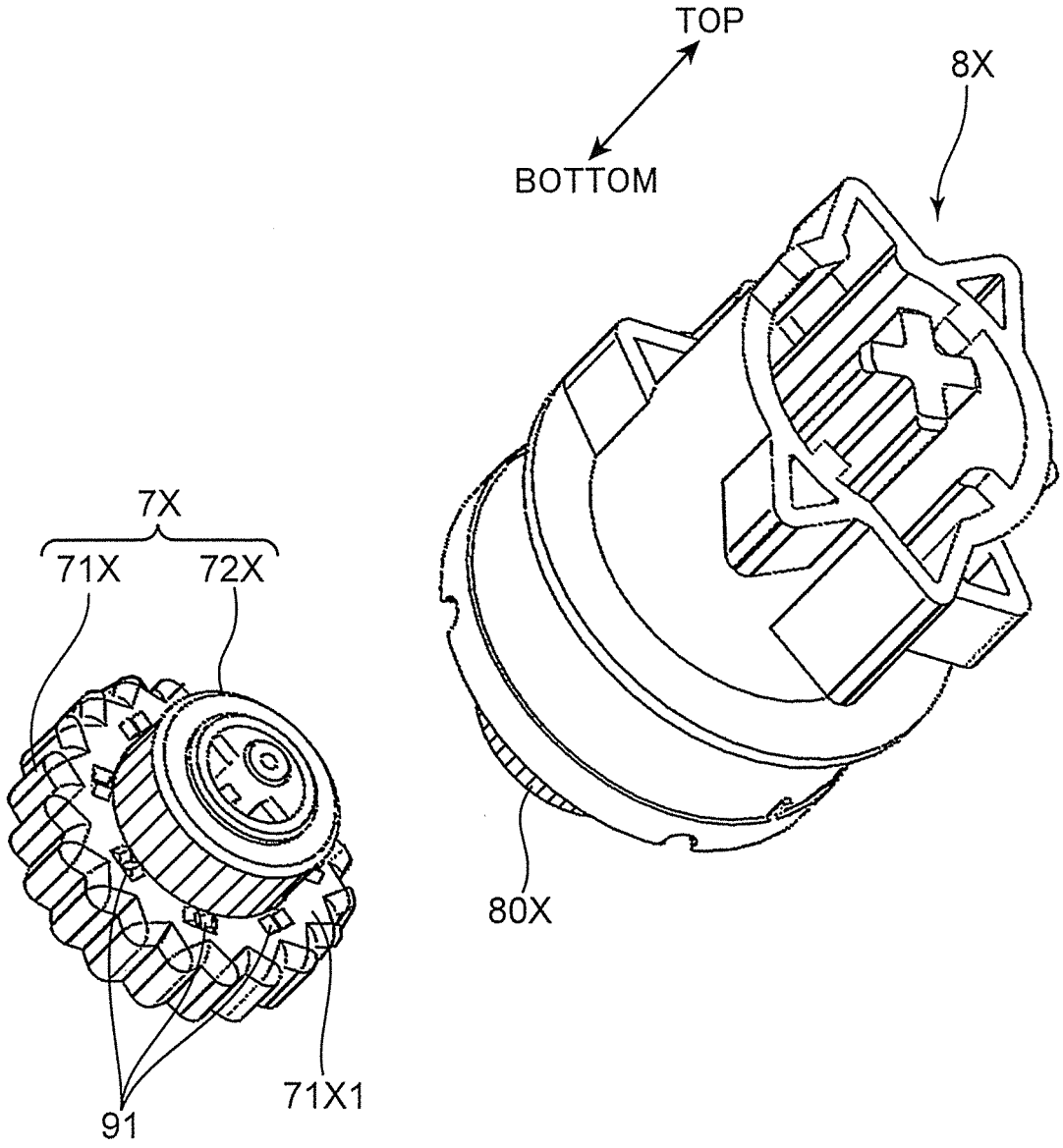
FIG. 18 is a perspective view of the first rotary member and the second rotary member according to the second embodiment of the present disclosure.
Figure 19:
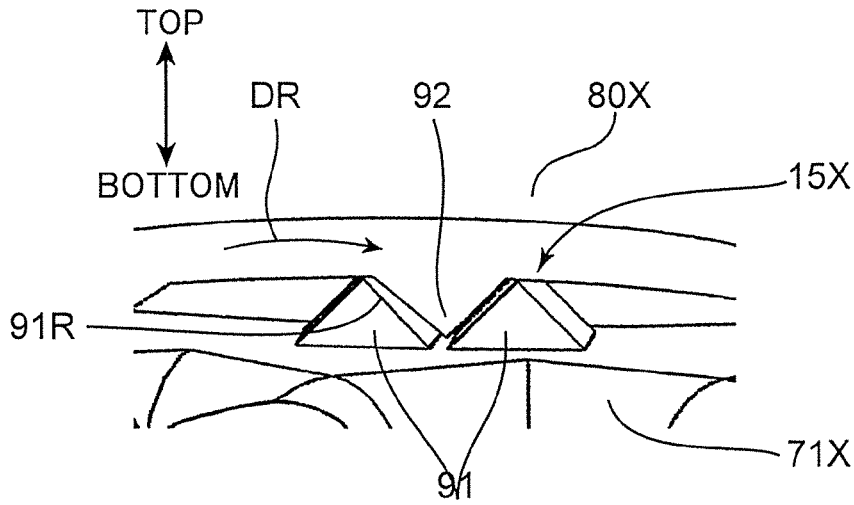
FIG. 19 is an enlarged perspective view illustrating engagement between a first protrusion and a second protrusion in the second embodiment of the present disclosure.

Now, a sheet size setting device 112X according to a second embodiment of the present disclosure will be described with reference to FIGS. 14 to 19. FIGS. 14 to 16 are a perspective view of an operation dial 7X and a pressing unit 8X bearing an assisting mechanism 15X, and their peripheries according to the second embodiment. FIGS. 17 and 18 are a perspective view of the operation dial 7X and the pressing unit 8X. FIG. 19 is an enlarged perspective view illustrating contact between operation protrusions 91 of an operation portion 71X and unit protrusions 92 of a unit gear 80X to be described later. The second embodiment differs from the first embodiment in configurations of a dial gear 72X and the unit gear 80X. Accordingly, only the difference will be described, and repeated description of the other common features will be omitted. In FIGS. 14 to 19, elements that are denoted by a reference numeral of an element in the first embodiment with X added at the end have substantially equivalent structure and function to those of the corresponding elements in the first embodiment.

Also in the second embodiment, the assisting mechanism 15X imparts a moving force to the pressing unit 8X in the axial direction with rotation of the operation dial 7X around a dial shaft (not shown) so that one of engagement concave portions 812X disengages from an engagement protrusion 110PX against a biasing force of an unillustrated spring. In addition, in the second embodiment, the assisting mechanism 15X includes the operation protrusions 91 (second protrusions) and the unit protrusions 92 (first protrusions).

With reference to FIG. 17, the pressing unit 8X includes the unit gear 80X (first gear portion) in the same manner as the unit gear 80 of the first embodiment. In the second embodiment, the unit gear 80X is in the form of a spur gear. The unit gear 80X has a first end surface 80X1 (FIG. 17) facing in the axial direction of the pressing unit 8X. The first end surface 80X1 is equivalent to the lower surface of the unit gear 80X. The plurality of unit protrusions 92 constituting a part of the assisting mechanism 15X are disposed in the circumferential direction of the unit gear 80X and protrude downward from the first end surface 80X1 as shown in FIG. 17. The unit protrusion 92 has a substantially triangular shape in a radial view and a predetermined width in the radial direction.

On the other hand, with reference to FIG. 18, the operation dial 7X includes the operation portion 71X (disk portion) and the dial gear 72X (second gear portion). In the second embodiment, the dial gear 72X is in the form of a spur gear similarly to the unit gear 80X, and is coupled with the unit gear 80X. The operation portion 71X is disposed adjacently to the dial gear 72X in the axial direction and has a larger diameter than that of the dial gear 72X. The operation portion 71X has a second end surface 71X1 (FIG. 18). The second end surface 71X is a surface of the operation portion 71X on the dial gear 72X. In a state where the operation dial 7X and the pressing unit 8X are mounted on the left side of a first wall part 110F1X (FIGS. 14 to 16), at least a part of the second end surface 71X1 faces the first end surface 80X1 in the axial direction. The plurality of operation protrusions 91 constituting a part of the assisting mechanism 15X are disposed in the circumferential direction of the operation portion 71X and each protrude from the second end surface 71X1 so as to face the unit protrusion 92, as shown in FIG. 18. Each of the operation protrusions 91 consists of a pair of adjacent protrusions each having a substantially triangular shape in a radial view and a predetermined width in the radial direction. The plurality of operation protrusions 91 are disposed in such a way as to surround the dial gear 72X as shown in FIG. 18.

Similarly to the first embodiment, when a user operating the image forming apparatus 1 rotates the operation portion 71X in a specific rotation direction (an arrow DR in FIG. 15), a driving force for rotation is transmitted from the dial gear 72X to the unit gear 80X to rotate the pressing unit 8X. This consequently allows setting of a size of sheets S, similarly to the first embodiment. In the second embodiment, when the driving force for rotation is transmitted from the dial gear 72X to the unit gear 80X owing to the rotation of the operation dial 7X, the operation protrusion 91 comes into contact with the unit protrusion 92 and the unit protrusion 92 climbs over the operation protrusion 91 to thereby impart a moving force to the pressing unit 8X in the axial direction (in the upward direction). This allows the engagement concave portion 812X to easily disengage from the engagement protrusion 110PX. Consequently, the setting of a size of sheets S can be accomplished at a reduced operational force. Further, when the operation dial 7X is not rotated by a user, the engagement concave portion 812X is prevented from disengaging from the engagement protrusion 110PX by the biasing force of the unillustrated spring. This prevents the pressing unit 8X from accidentally rotating when an unillustrated cassette is mounted. In this manner, an incorrect setting of a sheet size can be prevented.

Particularly in the second embodiment, with reference to FIG. 19, the operation protrusion 91 has an oblique surface 91R in the rotation direction (an arrow DR) of the operation dial 7X for guiding the unit protrusion 92 in the axial direction. Therefore, when the operation protrusion 91 is moved in the arrow DR direction, the unit protrusion 92 is pushed upward by the oblique surface 91R. This can consequently remarkably reduce the operational force required for a user to set a sheet size. In this manner, the second embodiment allows the operation protrusions 91 to be disposed by utilizing the second end surface 71X1 of the operation portion 71X. Further, because the operation protrusions 91 are disposed on the operation portion 71X that is operated by a user, the unit protrusion 92 (pressing unit 8) can move in the axial direction by a force greater than that of the case where the operation protrusions 91 are disposed at another position.

The sheet size setting devices 112, 112X, and the sheet feeding section 20 and the image forming apparatus 1 including the same have been described above. In the above-described sheet feeding section 20, sheets S can be fed from the cassette 110 in a state where a size of a sheet S is stably detected. Further, in the image forming apparatus 1, an image can be stably formed on a sheet S of an appropriate size. On the other hand, the present disclosure is not limited to the above embodiments and, for example, the following modified embodiments may be adopted.

Figure 20:
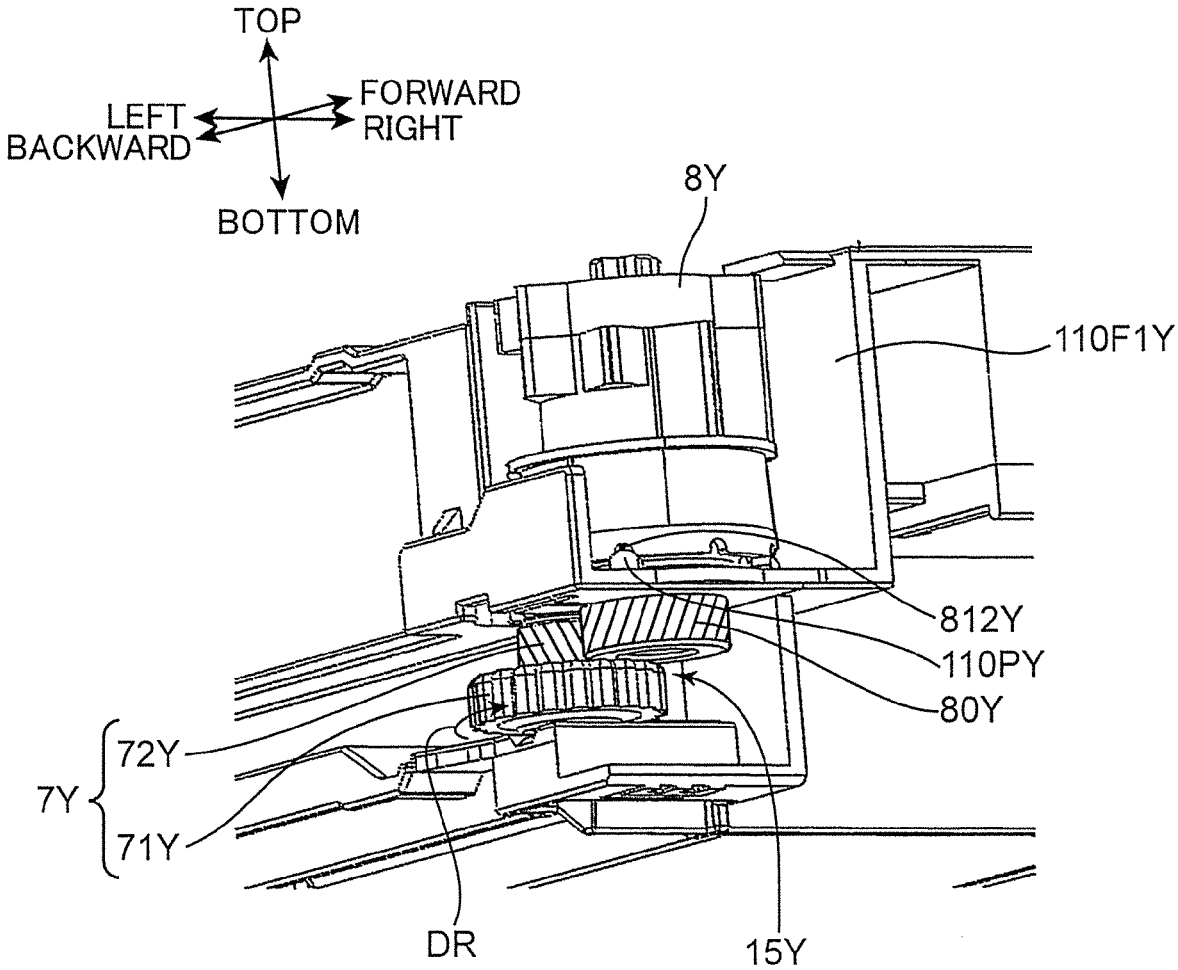
FIG. 20 is an enlarged perspective view showing the inside of a sheet feeding cassette according to a modified embodiment of the present disclosure.
Figure 21:
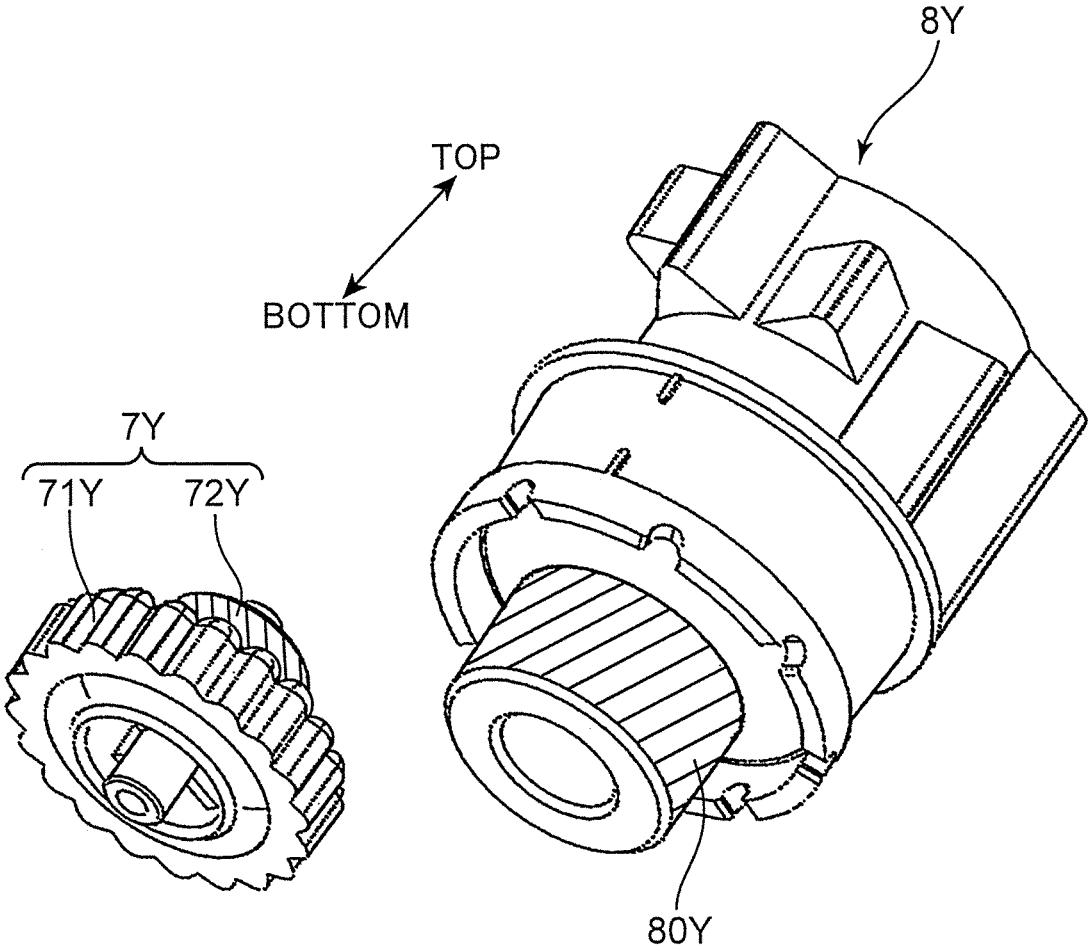
FIG. 21 is a perspective view of a first rotary member and a second rotary member according to the modified embodiment of the present disclosure.
Figure 22:
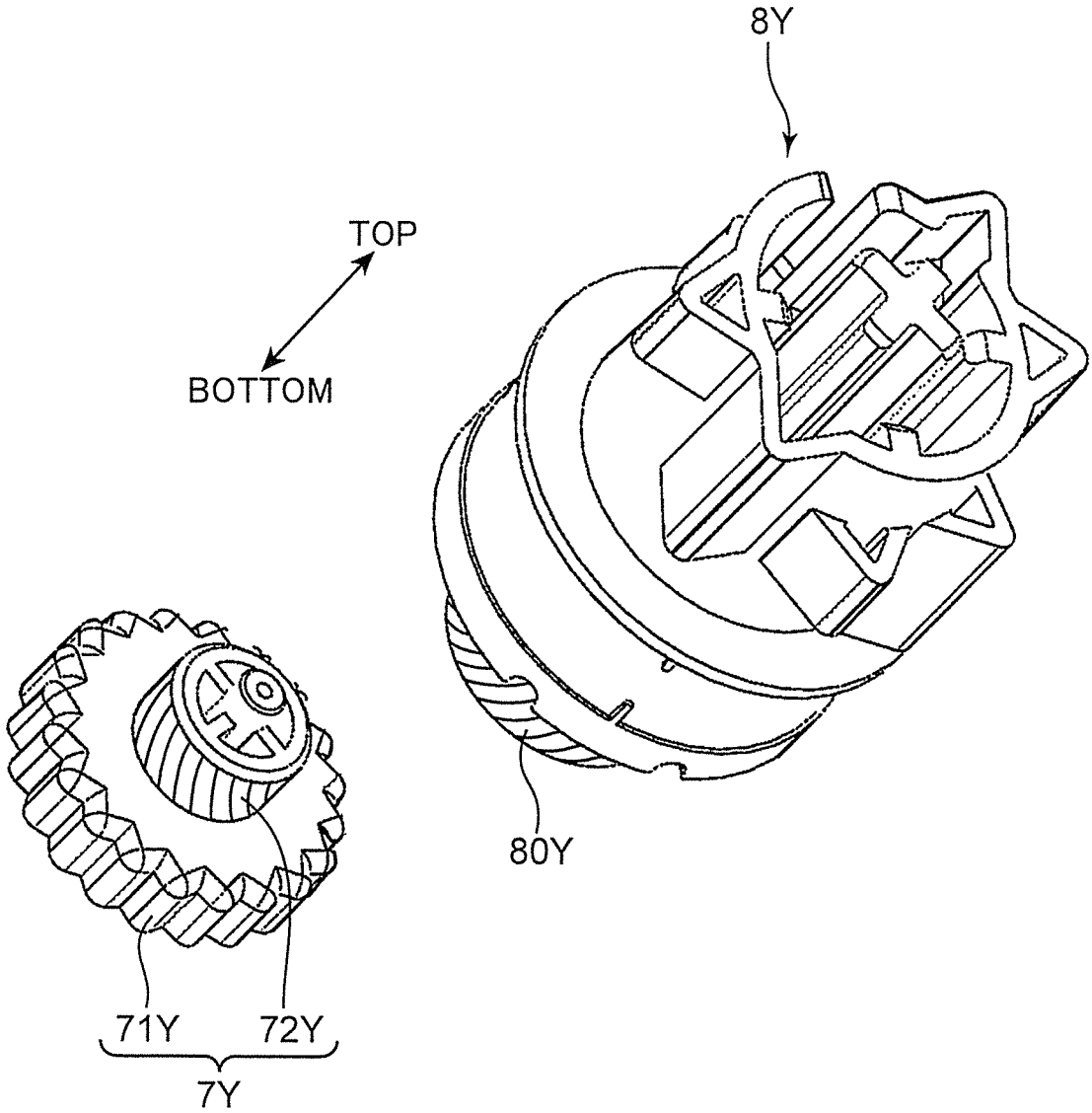
FIG. 22 is a perspective view of the first rotary member and the second rotary member according to the modified embodiment of the present disclosure.

(1) In the first embodiment, the unit gear 80 has an outer diameter equal to that of the dial gear 72. In other words, a gear ratio in the rotational driving force transmission from the dial gear 72 to the unit gear 80 is set at 1. However, the gear ratio of the present disclosure is not limited to the above-mentioned value. FIG. 20 is a perspective view of an assisting mechanism 15Y of a sheet detector and its peripheries according to a modified embodiment of the present disclosure. FIGS. 21 and 22 are a perspective view of an operation dial 7Y and a pressing unit 8Y bearing an assisting mechanism 15Y. This modified embodiment differs from the first embodiment in configurations of a dial gear 72Y and a unit gear 80Y. Accordingly, only the difference will be described, and repeated description of the other common features will be omitted. In FIGS. 20 to 22, elements that are denoted by a reference numeral of an element in the first embodiment with Y added at the end have substantially equivalent structure and function to those of the corresponding elements in the first embodiment.

In the present modified embodiment, the dial gear 72Y has an outer diameter smaller than that of the unit gear 80Y, and includes a less number of oblique teeth than those of the unit gear 80Y. In other words, a gear ratio of rotational driving force transmission from the dial gear 72Y to the unit gear 80Y is set at a value greater than 1. Therefore, an operational force of a user (worker) rotating the operation dial 7 can be increased owing to the gear ratio while the pressing unit 8 is rotated. This can consequently remarkably reduce the operational force required for a user to set a size of sheets S.

(2) In the first embodiment, a user operates the operation dial 7 to directly rotate the pressing unit 8. However, the way of rotating the pressing unit 8 of the present disclosure is not limited to this. An intermediate gear may be disposed between an operation dial 7 and a first gear portion 80 of a pressing unit 8 shown in FIG. 11 to allow a user to rotate the operation dial 7 to rotate the intermediate gear. Even in this case, disengagement of an engagement concave portion 812 from an engagement protrusion 110P is promoted in rotational driving force transmission from the intermediate gear to the pressing unit 8.

(3) Further, in the second embodiment, the assisting mechanism 15X is on the operation protrusions 91 and the unit protrusions 92. However, the configuration of the assisting mechanism of the present disclosure is not limited to this. In another modified embodiment, a group of operation protrusions 91 and a group of unit protrusions 92 may be disposed on a dial gear 72X and a unit gear 80X, respectively, the dial gear 72X and the unit gear 80X being in the form of a helical gear similarly to the first embodiment.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A sheet size setting device for giving information for identifying a sheet size to a sheet size detector, the sheet size setting device comprising:

a housing including a first mounting section having a first space, and a second mounting section adjacent to the first mounting section and having a second space;

a first rotary member having a cylindrical shape, and supported on the first mounting section, and rotatable around and slidably movable along a first axis extending to the second space in the first space an engaging portion provided in the housing;

a biasing member;

a second rotary member supported on the second mounting section rotatably around a second axis parallel to the first axis; and an assisting mechanism, wherein the first rotary member includes a first region, a second region, and a third region along the first axis, the first rotary member further including:

a plurality of detected portions to be detected by the sheet size detector, the plurality of detected portions being disposed in the first region, and in a circumferential direction of the first rotary member;

a plurality of engaged portions to be selectively engaged with the engaging portion, the plurality of engaged portions being disposed in the second region, and corresponding to the plurality of detected portions in the circumferential direction of the first rotary member; and a first gear portion disposed in the third region for receiving a driving force for rotation around the first axis, wherein the housing includes:

a first supporting plate defining one end of the first space in the first axis direction of the first rotary member;

a second supporting plate disposed oppositely to the first supporting plate to define the other end of the first space in the first axis direction, and dividing the first space from the second space, the second supporting plate having a bearing opening allowing the first gear portion of the first rotary member to pass therethrough, and the second supporting plate supporting the first rotary member with the first supporting plate, wherein the engaging portion is disposed on the second supporting plate in such a way as to face one of the plurality of engaged portions, the engaging portion being operable to engage with the one of the plurality of engaged portions in the rotation of the first rotary member around the first axis to thereby restrict the rotation of the first rotary member, wherein the biasing member is disposed between the first supporting plate and the first rotary member for biasing the first rotary member in a direction of permitting the one of the plurality of engaged portions to engage with the engaging portion, wherein the second rotary member includes:

a second gear portion disposed on the second axis and engaged with the first gear portion; and a disk portion for rotating the second gear portion, wherein the second rotary member is rotated in a specific direction around the second axis to rotate the first rotary member to set a sheet size, and wherein the assisting mechanism applies a moving force to the first rotary member in the axial direction with the rotation of the second rotary member around the second axis so that the one of the plurality of engaged portions disengages from the engaging portion against the biasing force of the biasing member.

2. A sheet size setting device according to claim 1, wherein the assisting mechanism is on the first gear portion and the second gear portion, the first gear portion and the second gear portion each includes a helical gear having gear teeth inclined with respect to the axial direction thereof, and in the driving force transmission from the second gear portion to the first gear portion owing to the rotation of the second rotary member, the helical gears engage with each other to thereby apply the moving force in the axial direction to the first rotary member.

3. A sheet size setting device according to claim 2, wherein the second gear portion includes a smaller number of gear teeth than the first gear portion.

4. A sheet size setting device according to claim 1, wherein the first gear portion has a first end surface, wherein the disk portion is disposed adjacently to the second gear portion in the axial direction, and has a larger diameter than the second gear portion and a second end surface including at least a part facing the first end surface in the axial direction, wherein the assisting mechanism includes:

a plurality of first protrusions projecting from the first end surface of the first gear portion, and disposed in a circumferential direction of the first gear portion; and a plurality of second protrusions projecting from the second end surface of the disk portion so as to face the first protrusions, and disposed in the circumferential direction of the disk portion, and wherein in the driving force transmission from the second gear portion to the first gear portion owing to the rotation of the second rotary member, a second protrusion comes into contact with a first protrusion and the first protrusion climbs over the second protrusion to thereby apply the moving force in the axial direction to the first rotary member.

5. A sheet size setting device according to claim 4, wherein the second protrusions each has an oblique surface in the rotational direction of the second rotary member for guiding a first protrusion in the axial direction.

6. A sheet size setting device according to claim 4, wherein the disk portion of the second rotary member constitutes a dial to be rotated for rotating the second rotary member around the second axis.

7. A sheet feeding apparatus, comprising:

the sheet size setting device according to claim 1;

a sheet feeding cassette for storing sheets, a part of the sheet feeding cassette constituting the housing;

a frame allowing the sheet feeding cassette to be mounted in a predetermined mounting direction; and a sheet feeder disposed in the frame for feeding the sheet from the sheet feeding cassette, the sheet size detector being disposed in the frame to detect a size of a sheet stored in the sheet feeding cassette by detecting the detected portion.

8. A sheet feeding apparatus according to claim 7, wherein the assisting mechanism includes the first gear portion and the second gear portion, the first gear portion and the second gear portion each including a helical gear having gear teeth inclined with respect to the axial direction thereof, in the driving force transmission from the second gear portion to the first gear portion owing to the rotation of the second rotary member, the helical gears engage with each other to thereby apply the moving force in the axial direction to the first rotary member, the sheet size detector includes a plurality of contact switches each operable to move in and out in accordance with contact with the detected portion, the detected portions each includes a contour irregularity formed in the circumferential direction of the first rotary member to serve as a detection pattern for identification of a sheet size by the plurality of contact switches, the contour irregularity comes into contact with the contact switch in the mounting direction when the sheet feeding cassette is mounted on the frame, when the contour irregularity comes into contact with the contact switch, the first rotary member receives a reactive force in a direction opposite to the direction of the rotation of the first rotary member around the first axis.

9. A sheet feeding apparatus according to claim 7, further comprising:

a plurality of sheet size indication members corresponding to different sheet sizes, and disposed on a circumferential surface of the second region of the first rotary member in the circumferential direction to indicate sheet sizes, wherein the sheet feeding cassette is formed with an window for allowing one of the plurality of sheet size indication members to be exposed to the outside of the sheet feeding cassette with the rotation of the first rotary member.

10. An image forming apparatus, comprising:

the sheet feeding apparatus according to claim 7; and an image former for forming an image on a sheet supplied from the sheet feeding cassette.

* * * * *